US011482156B2

(12) United States Patent
Huang et al.

(10) Patent No.: US 11,482,156 B2
(45) Date of Patent: Oct. 25, 2022

(54) GATE DRIVING CIRCUIT, DISPLAY DEVICE AND DISPLAY CONTROL METHOD

(71) Applicants: CHENGDU BOE OPTOELECTRONICS TECHNOLOGY CO., LTD., Chengdu (CN); BOE TECHNOLOGY GROUP CO., LTD., Beijing (CN)

(72) Inventors: Yao Huang, Beijing (CN); Weiyun Huang, Beijing (CN)

(73) Assignees: CHENGDU BOE OPTOELECTRONICS TECHNOLOGY CO., LTD., Sichuan (CN); BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 17/264,695

(22) PCT Filed: May 28, 2020

(86) PCT No.: PCT/CN2020/092932
§ 371 (c)(1),
(2) Date: Jan. 29, 2021

(87) PCT Pub. No.: WO2020/239028
PCT Pub. Date: Dec. 3, 2020

(65) Prior Publication Data

US 2021/0312854 A1 Oct. 7, 2021

(30) Foreign Application Priority Data

May 31, 2019 (CN) ..... 201910471610.2

(51) Int. Cl.
*G09G 3/3266* (2016.01)
*G09G 3/20* (2006.01)

(52) U.S. Cl.
CPC ... *G09G 3/2092* (2013.01); *G09G 2310/0267* (2013.01); *G09G 2310/0286* (2013.01)

(58) Field of Classification Search
CPC ..... G09G 3/2092; G09G 2310/0267; G09G 2310/0286; G09G 2320/0233;
(Continued)

(56) References Cited

U.S. PATENT DOCUMENTS 5,859,548 A * 1/1999 Kong ..... H03K 19/0963 365/205
10,297,219 B2 5/2019 Zhang et al.
(Continued)

FOREIGN PATENT DOCUMENTS

CN 105513556 A 4/2016
CN 105702193 A 6/2016
(Continued)

OTHER PUBLICATIONS

First Chinese Office Action dated Jun. 16, 2021, received for corresponding Chinese Application No. 201910471610.2, 22 pages.

*Primary Examiner* — Jose R Soto Lopez
(74) *Attorney, Agent, or Firm* — Kinney & Lange, P.A.

(57) ABSTRACT

The embodiments of the present disclosure provide a gate driving circuit, a display device, and a display control method. The gate driving circuit includes: a first gate driving sub-circuit configured to output a scan signal and control the first display area to display according to the scan signal; a display area control unit having an input terminal configured to receive the scan signal output by the first gate driving sub-circuit, a control terminal configured to receive a split-screen control signal output by the split-screen control signal terminal, and an output terminal configured to output or not output the scan signal according to the split-screen control signal; and a second gate driving sub-circuit configured to
(Continued)

control a display state of the second display area according to whether the scan signal is received or not.

18 Claims, 10 Drawing Sheets

(58) Field of Classification Search
CPC .... G09G 3/3266; G09G 3/3677; G09G 3/035; G09G 3/20; G09G 3/001
See application file for complete search history.

(56) References Cited

U.S. PATENT DOCUMENTS

| | | | | |
|---|---|---|---|---|
| 10,424,252 | B2 | 9/2019 | Kong | |
| 10,991,330 | B1 * | 4/2021 | Li | G09G 3/3674 |
| 2008/0055225 | A1 * | 3/2008 | Pak | G09G 3/3677 345/100 |
| 2015/0235634 | A1 * | 8/2015 | Liu | H03K 19/0013 326/50 |
| 2016/0225311 | A1 * | 8/2016 | Hwang | G09G 3/3208 |
| 2016/0293079 | A1 | 10/2016 | Kim et al. | |
| 2018/0226037 | A1 * | 8/2018 | Zhang | G09G 3/3677 |
| 2019/0096333 | A1 * | 3/2019 | Park | G09G 3/3258 |
| 2019/0385517 | A1 | 12/2019 | Zeng | |
| 2020/0051479 | A1 * | 2/2020 | Lee | G09G 3/20 |
| 2021/0217339 | A1 | 7/2021 | Zheng et al. | |

FOREIGN PATENT DOCUMENTS

| | | | |
|---|---|---|---|
| CN | 106023923 | A | 10/2016 |
| CN | 106328081 | A | 1/2017 |
| CN | 107945666 | A | 4/2018 |
| CN | 108877632 | A | 11/2018 |
| CN | 111192545 | A | 5/2020 |
| KR | 20160117758 | A | 10/2016 |
| KR | 20180077804 | A | 7/2018 |

* cited by examiner

GATE DRIVING CIRCUIT, DISPLAY DEVICE AND DISPLAY CONTROL METHOD

CROSS-REFERENCE TO RELATED APPLICATION(S)

This application is a Section 371 National Stage Application of International Application No. PCT/CN2020/092932, filed on May 28, 2020, entitled "GATE DRIVING CIRCUIT, DISPLAY DEVICE AND DISPLAY CONTROL METHOD", which claims priority to Chinese Patent Application No. 201910471610.2, entitled "GATE DRIVING CIRCUIT, DISPLAY DEVICE AND DISPLAY CONTROL METHOD", filed on May 31, 2019, which is incorporated herein by reference in its entirety.

TECHNICAL FIELD

The present disclosure relates to a field of display technology, and in particular to a gate driving circuit, a display device, and a display control method.

BACKGROUND

In an existing display device, when there are two adjacent display areas that may be displayed separately, a separate gate start signal terminal is usually provided for each display area.

In a conventional display device, in different display areas of the display device, such as a first display area and a second display area, when simultaneous display is required, two separate gate start signal terminals STV1 and STV2 outputs gate start signals to corresponding display areas, respectively. The first display area and the second display area display under controls of the gate start signals output by the corresponding gate start signal terminals STV1 and STV2.

SUMMARY

In a first aspect, the embodiments of the present disclosure provide a gate driving circuit, comprising: a first gate driving sub-circuit, wherein an input terminal of the first gate driving sub-circuit is electrically coupled to a gate start signal terminal, a plurality of output terminals of the first gate driving sub-circuit are electrically coupled to multiple rows of sub-pixels in a first display area of a display device, and the first gate driving sub-circuit is configured to output a scan signal and control the first display area to display according to the scan signal; a display area control unit, wherein an input terminal of the display area control unit is coupled to one of the output terminals of the first gate driving sub-circuit, and is configured to receive the scan signal output by the first gate driving sub-circuit, a control terminal of the display area control unit is coupled to a split-screen control signal terminal, and is configured to receive a split-screen control signal output by the split-screen control signal terminal, and an output terminal of the display area control unit is configured to output or not output the scan signal according to the split-screen control signal; and a second gate driving sub-circuit, wherein an input terminal of the second gate driving sub-circuit is electrically coupled to the output terminal of the display area control unit, and a plurality of output terminals of the second gate driving sub-circuit are electrically coupled to multiple rows of sub-pixels in a second display area of the display device, and the second gate driving sub-circuit is configured to control a display state of the second display area according to whether the scan signal is received or not.

Optionally, the display area control unit comprises: a first transistor; a first electrode of the first transistor is used as the input terminal of the display area control unit and is electrically coupled to one of the output terminals of the first gate driving sub-circuit, a control electrode of the first transistor is electrically coupled to the split-screen control signal terminal, and a second electrode of the first transistor is used as the output terminal of the display area control unit; and wherein the display area control unit is configured to: in a full-screen display phase, receive a first control signal output by the split-screen control signal terminal and output the scan signal output by one of the output terminals of the first gate driving sub-circuit at the output terminal of the display area control unit; and in a split-screen display phase, receive a second control signal output by the split-screen control signal terminal without outputting the scan signal at the output terminal of the display area control unit.

Optionally, the display area control unit further comprises: a capacitor, and two terminals of the capacitor are electrically coupled to the input terminal of the display area control unit and the output terminal of the display area control unit, respectively.

Optionally, the first gate driving sub-circuit comprises M cascaded first shift registers, and the second gate driving sub-circuit comprises N cascaded second shift registers, wherein M and N are positive integers greater than or equal to 2, respectively; and wherein a signal input terminal of a first stage of the first shift register is coupled to the gate start signal terminal, an output terminal of a M stage of the first shift register is coupled to the input terminal of the display area control unit, and a signal input terminal of a first stage of the second shift register is coupled to the output terminal of the display area control unit.

In a second aspect, the embodiments of the present disclosure provide a display device, comprising the first display area, the second display area, and the gate driving circuit described above; wherein the first gate driving sub-circuit in the gate driving circuit is electrically coupled to each row of sub-pixels in the first display area; the display area control unit in the gate driving circuit is electrically coupled between the first gate driving sub-circuit and the second gate driving sub-circuit; and the second gate driving sub-circuit in the gate driving circuit is electrically coupled to each row of sub-pixels in the second display area.

Optionally, the display device further comprises: a driving control circuit configured to provide the gate start signal and the split-screen control signal.

In a third aspect, the embodiments of the present disclosure provide a display control method applied to the gate driving circuit described above, comprising: in a full-screen display phase, providing a first control signal to the split-screen control signal terminal to cause the display area control unit to transmit the scan signal output by one of the output terminals of the first gate driving sub-circuit to the input terminal of the second gate driving sub-circuit; and in a split-screen display phase, providing a second control signal to the split-screen control signal terminal to cause the display area control unit to not transmit the scan signal output by one of the output terminals of the first gate driving sub-circuit to the input terminal of the second gate driving sub-circuit.

BRIEF DESCRIPTION OF THE DRAWINGS

The above and/or additional aspects and advantages of the present disclosure will become obvious and easy to understand from the following description of the embodiments in conjunction with the accompanying drawings, in which.

DETAILED DESCRIPTION OF EMBODIMENTS

Figure 1A:
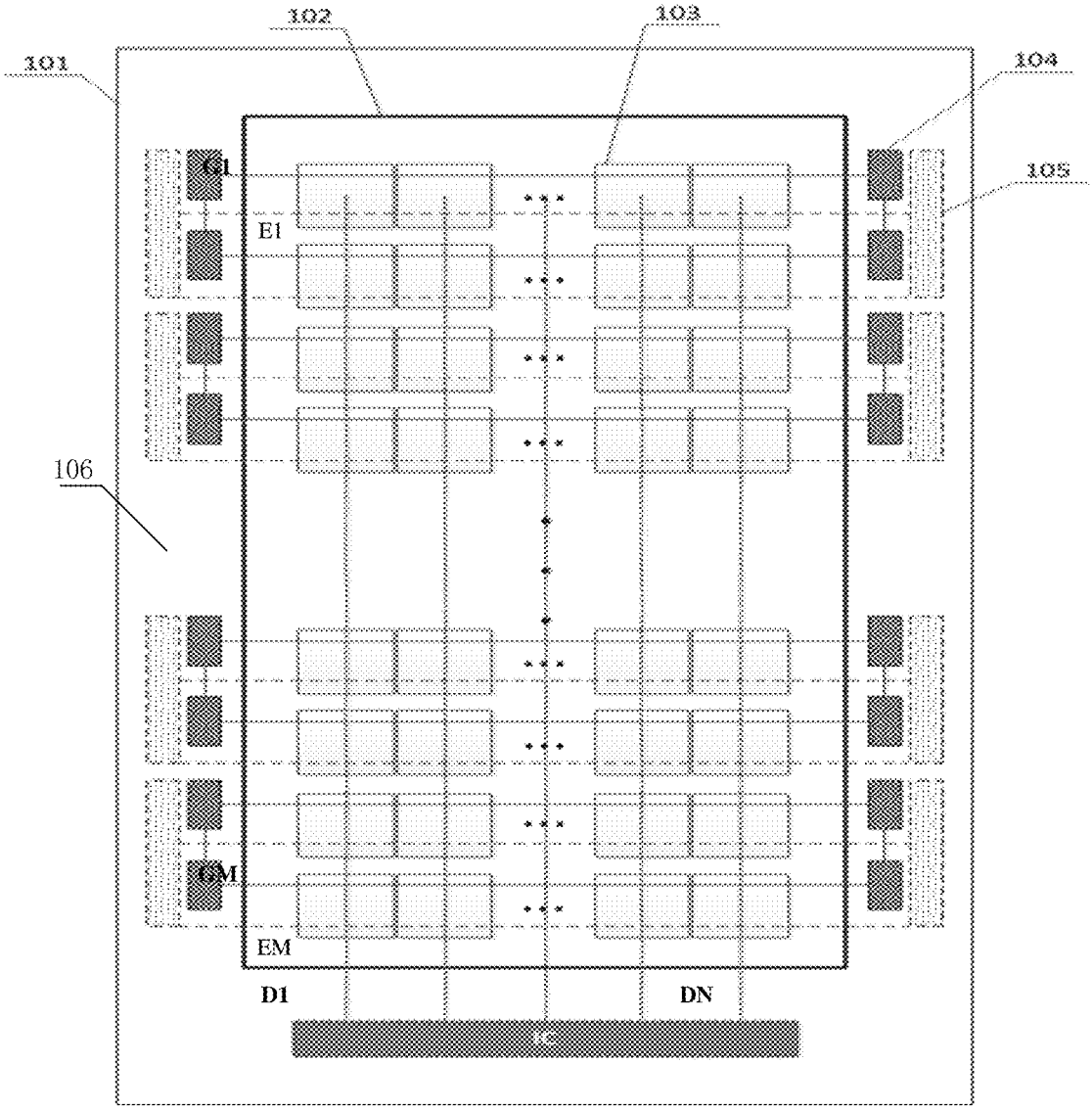
FIG. 1A is a schematic diagram of an overall circuit structure of the display panel.

The present disclosure will be described in detail below. Examples of embodiments of the present disclosure are shown in the accompanying drawings, and the same or similar reference numerals from beginning to end indicate the same or similar components or components with the same or similar functions. In addition, if a detailed description of a known technology is unnecessary for illustrated features of the present disclosure, it will be omitted. The embodiments described below with reference to the drawings are exemplary, and are only used to explain the present disclosure, and cannot be construed as a limitation to the present disclosure.

Those skilled in the art may understand that, unless otherwise defined, all terms (including technical terms and scientific terms) used herein have the same meanings as commonly understood by those of ordinary skill in the art to which this disclosure belongs. It should also be understood that terms such as those defined in a general dictionary should be understood as having a meaning consistent with a meaning in the context of the related art, and unless specifically defined as here, they will not be interpreted in ideal or overly formal meanings.

Those skilled in the art may understand that, unless specifically stated otherwise, the singular forms "a", "an", "said" and "the" used herein may also include plural forms. It should be further understood that the term "comprising" used in the specification of this disclosure refers to the presence of the described features, integers, steps, operations, elements and/or components, but does not exclude the presence or addition of one or more other features, integers, steps, operations, elements, components, and/or groups thereof. The term "and/or" used herein includes all or any unit and all combinations of one or more associated listed items.

The technical solutions of the present disclosure and how the technical solutions of the present disclosure solve the above technical problems are described in detail below with specific embodiments. The following specific embodiments may be combined with each other, and the same or similar concepts or processes may not be repeated in some embodiments. The embodiments of the present disclosure will be described below in conjunction with the drawings.

FIG. 1A is a schematic diagram of an overall circuit structure of a display panel. For example, as shown in FIG. 1A, the display panel includes a base substrate 101, and the base substrate 101 includes a display area (i.e., a pixel array area) 102 and a peripheral area 106 located around the display area 102. For example, the peripheral area 106 surrounds the display area 102. The display area 102 includes pixel units 103 arranged in an array, and the peripheral area 106 includes shift register units 104. A plurality of cascaded shift register units 104 form a gate driving circuit for providing, for example, gate scan signals shifted row by row, to the pixel units 103 arranged in an array in the display area 102 of the display panel. The peripheral area 106 further includes light-emitting control units 105. A plurality of cascaded light-emitting control units 105 form a light-emitting control array for providing, for example, light-emitting control signals shifted row-by-row, to the pixel units 103 arranged in an array in the display area 102 of the display panel.

As shown in FIG. 1A, the display panel further includes a data driving chip IC located in the peripheral area 106, and the data driving chip IC is configured to provide data signals to the pixel units 103 arranged in an array. Data lines D1-DN (N is an integer greater than 1) coupled to the data driving chip IC cross the display area 102 longitudinally (for example, a vertical direction in the FIG.), to provide data signals for each column of the pixel units 103. Gate lines G1-GM (M is an integer greater than 1) coupled to the shift register units 104 cross the display area 102 laterally (for example, a horizontal direction in the FIG.), and light-emitting control lines E1-EM (M is an integer greater than 1) coupled to the light-emitting control units 105 cross the display area 102 laterally, to provide gate scan signals and light-emitting control signals for the pixel units 103 arranged in an array.

For example, each pixel unit 103 may include pixel circuits and light-emitting elements with circuit structures such as 7T1C, 8T2C, or 4T1C in the art. The pixel circuits operate under control of the data signals transmitted from data lines, the gate scan signals transmitted from gate lines, and the light-emitting control signals transmitted from the light-emitting control lines E1-EM, to drive the light-emitting elements to emit light to realize operations such as display. The light-emitting element may be, for example, an organic light-emitting diode (OLED) or a quantum dot light-emitting diode (QLED).

Figure 1B:
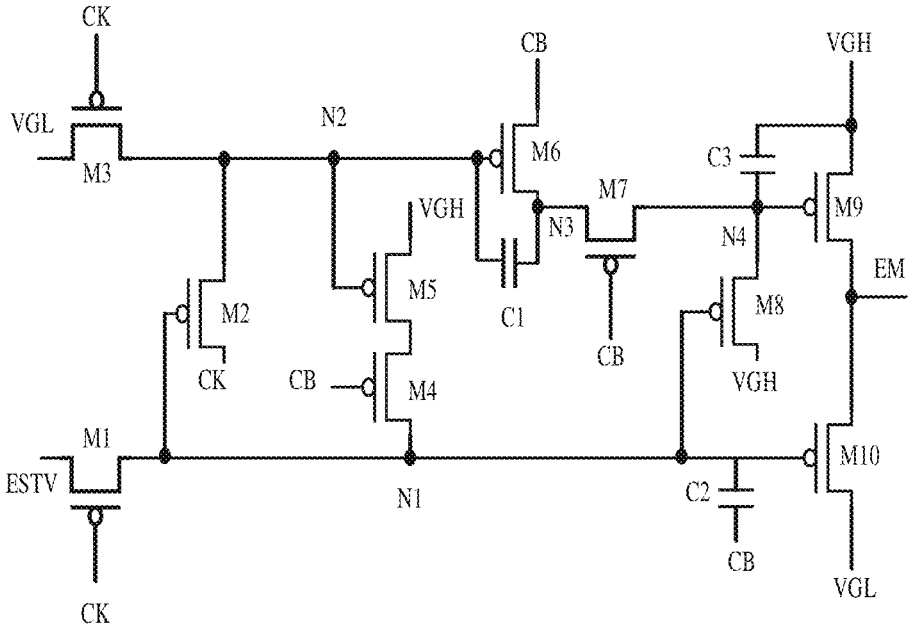
FIG. 1B shows a schematic typical structure of EMGOA.
Figure 1C:
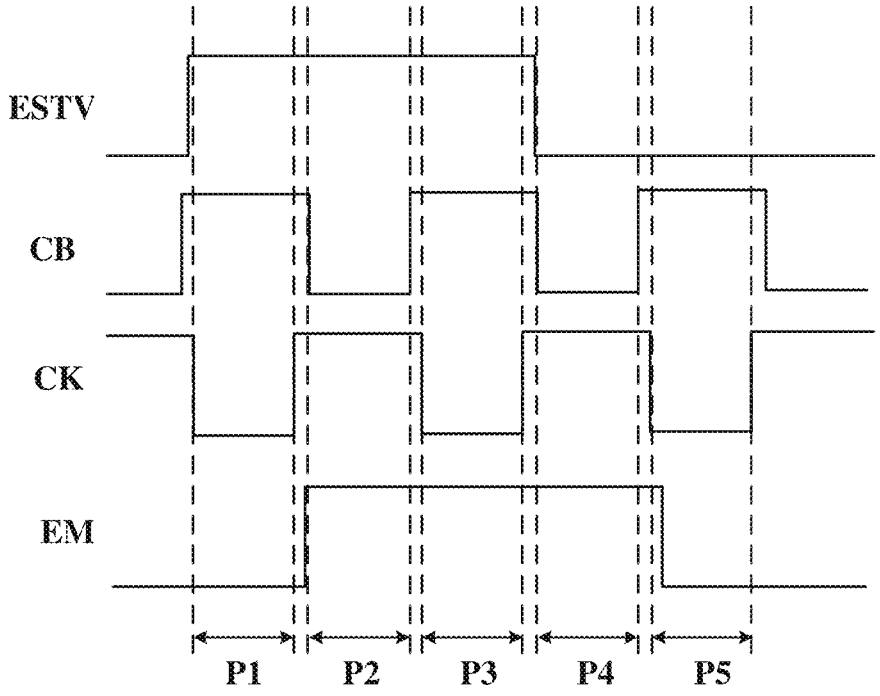
FIG. 1C shows an operating timing diagram of EMGOA.

FIG. 1B shows a schematic typical structure of EMGOA, and FIG. 1C shows a timing diagram of operating EMGOA. In a first phase P1, as a first clock signal CK is at a low level, a first transistor M1 and a third transistor M3 are turned on, and the turned-on first transistor M1 transmits a start signal ESTV being at a high level to a first Node N1, so that a level of the first node N1 becomes a high level, and thus a second transistor M2, an eighth transistor M8, and a tenth transistor M10 are turned off. In addition, the turned-on third transistor M3 transmits a fourth voltage VGL being at a low level to a second node N2, so that a level of the second node N2 becomes a low level, and thus a fifth transistor M5 and a sixth transistor M6 are turned on. As a second clock signal CB is at a high level, a seventh transistor M7 is turned off. In addition, due to a storage effect of a third capacitor C3, a level of a fourth node N4 may be maintained at a high level, so that a ninth transistor M9 is turned off. In the first phase P1, as the ninth transistor M9 and the tenth transistor M10 are both turned off, a light-emitting control pulse signal EM output by the light-emitting control shift register unit EGOA maintains at previous low level.

In a second phase P2, the second clock signal CB is at a low level, and thus the fourth transistor M4 and the seventh transistor M7 are turned on. As the first clock signal CK is at a high level, the first transistor M1 and the third transistor M3 are turned off. Due to a storage effect of a first capacitor C1, the second node N2 may continue to maintain at a low level of the previous phase, and thus the fifth transistor M5 and the sixth transistor M6 are turned on. A third voltage VGH being at a high level is transmitted to the first node N1 through the turned-on fifth transistor M5 and the fourth transistor M4, so that the level of the first node N1 continues to maintain at a high level of the previous phase, and the second transistor M2, the eighth transistor M8, and the tenth transistor M10 are turned off. In addition, the second clock signal CB being at a low level is transmitted to the fourth node N4 through the turned-on sixth transistor M6 and the seventh transistor M7, so that the level of the fourth node N4 becomes a low level, and thus the ninth transistor M9 is turned on, the turned-on ninth transistor M9 outputs the third voltage VGH being at a high level, and the light-emitting control pulse signal EM output by the light-emitting control shift register unit EGOA in the second phase P2 is at a high level.

In a third phase P3, the first clock signal CK is at a low level, and thus the first transistor M1 and the third transistor M3 are turned on. The second clock signal CB is at a high level, and thus the fourth transistor M4 and the seventh transistor M7 are turned off. Due to a storage effect of the third capacitor C3, the level of the fourth node N4 may maintain at a low level of the previous phase, so that the ninth transistor M9 remains in an on state, and the turned-on ninth transistor M9 outputs the third voltage VGH being at a high level, and the light-emitting control pulse signal EM output by the light-emitting control shift register unit EGOA in the third phase P3 is still at a high level.

In a fourth phase P4, the first clock signal CK is at a high level, and thus the first transistor M1 and the third transistor M3 are turned off. The second clock signal CB is at a low level, and thus the fourth transistor M4 and the seventh transistor M7 are turned on. Due to a storage effect of the second capacitor C2, the level of the first node N1 maintains at a high level of the previous phase, so that the second transistor M2, the eighth transistor M8, and the tenth transistor M10 are turned off. Due to the storage effect of the first capacitor C1, the second node N2 continues to maintain at a low level of the previous phase, so that the fifth transistor M5 and the sixth transistor M6 are turned on. In addition, the second clock signal CB being at a low level is transmitted to the fourth node N4 through the turned-on sixth transistor M6 and the seventh transistor M7, so that the level of the fourth node N4 becomes a low level, and thus the ninth transistor M9 is turned on, and the turned-on ninth transistor M9 outputs the third voltage VGH being at a high level, and the light-emitting control pulse signal EM output by the light-emitting control shift register unit EGOA in the second phase P2 is still at a high level.

In a fifth phase P5, the first clock signal CK is at a low level, and thus the first transistor M1 and the third transistor M3 are turned on. The second clock signal CB is at a high level, and thus the fourth transistor M4 and the seventh transistor M7 are turned off. The turned-on first transistor M1 transmits a start signal ESTV being at a low level to the first node N1, so that the level of the first node N1 becomes a low level, and thus the second transistor M2, the eighth transistor M8, and the tenth transistor M10 are turned on. The turned-on second transistor M2 transmits the first clock signal CK being at a low level to the second node N2, thereby further lowering the level of the second node N2, and the second node N2 continues to maintain at a low level of the previous phase, so that the fifth transistor M5 and the sixth transistor M6 are turned on. In addition, the turned-on eighth transistor M8 transmits the third voltage VGH being at a high level to the fourth node N4, so that the level of the fourth node N4 becomes a high level, and thus the ninth transistor M9 is turned off. The turned-on tenth transistor M10 outputs the fourth voltage VGL being at a low level, and the light-emitting control pulse signal EM output by the light-emitting control shift register unit EGOA in the fifth phase P5 is at a low level.

Figure 2:
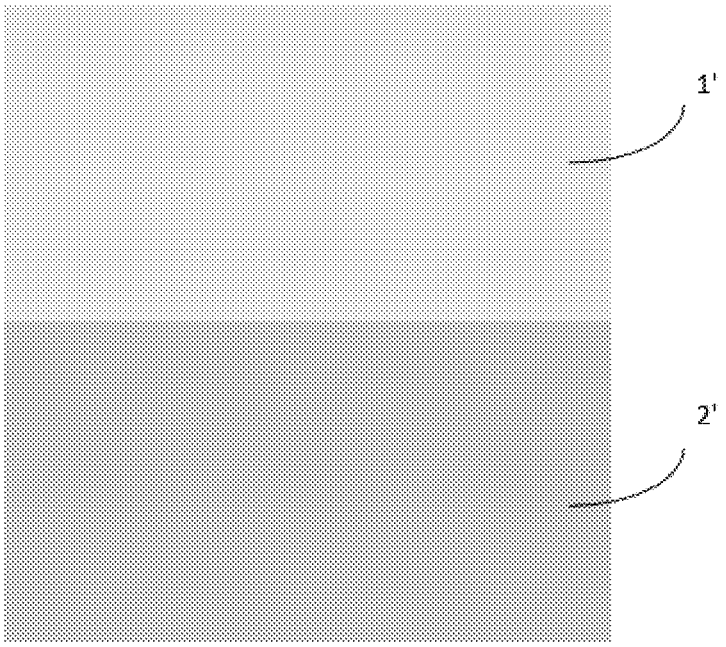
FIG. 2 is a schematic diagram of differences in display conditions between two adjacent display areas in a conventional display device.

The inventor of the present disclosure found that there are differences in display conditions between two adjacent display areas in a conventional display device. In a foldable display device, two adjacent display areas bounded by a folding position of the display device are likely to have differences in display conditions when both display areas are displayed. As shown in FIG. 2, a difference exists in display conditions between a first display area 1' and a second display area 2', which obviously affects a screen display effect of the display device.

The inventor of the present disclosure has discovered through research that, in a conventional display device, two gate start signal terminals STV1 and STV2 are required to be able to output same gate start signals to their corresponding display areas (for example, the first display area 1' and the second display area 2' in FIG. 2), so as to cause the two display areas to display coordinated pictures at the same time. In order to make signal output states of the two gate start signal terminals STV1 and STV2 the same, a control system of the display device needs to be provided with a control module that adjusts the frame synchronization of the two gate start signal terminals. To a certain extent, a frame control for the two gate start signal terminals increases a control burden of the display device.

Figure 3:
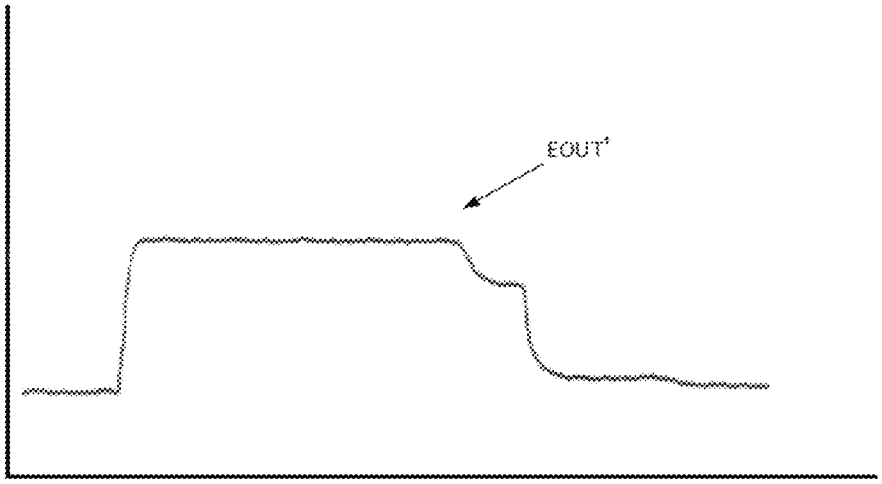
FIG. 3 is a schematic diagram of waveforms of EOUT' signals output by a shift register EM-(n) in a conventional display device.
Figure 4:
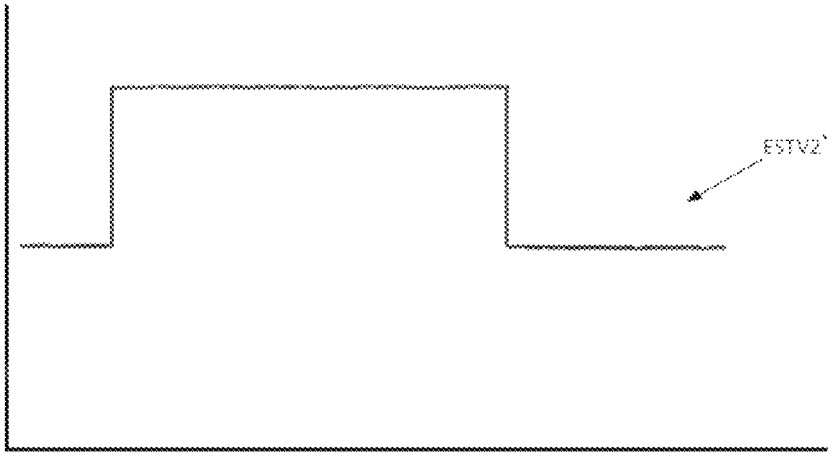
FIG. 4 is a schematic diagram of waveforms of ESTV2' signals output by a shift register EM-(n+1) in a conventional display device.

The inventor of the present disclosure further found that, even if the gate start signal terminals STV1 and STV2 corresponding to the two display areas may output the same gate start signals, at a boundary position of the two adjacent display areas, a waveform of a signal EOUT' received by the last row of sub-pixels Pixel(n) in the first display area and output by a shift register EM-(n) is different from a waveform of a signal ESTV2' received by the first row of sub-pixels Pixel(n+1) in the second display area and output by a shift register EM-(n+1). The waveforms of EOUT' and ESTV2' are shown in FIG. 3 and FIG. 4, respectively. This also causes a difference in display conditions between the first display area and the second display area, which affects the screen display effect of the display device.

The gate driving circuit, the display device, and the display control method provided by the present disclosure aim to at least partially solve a technical problem of display differences that occur when adjacent display areas output images at the same time in the related art.

Figure 5:
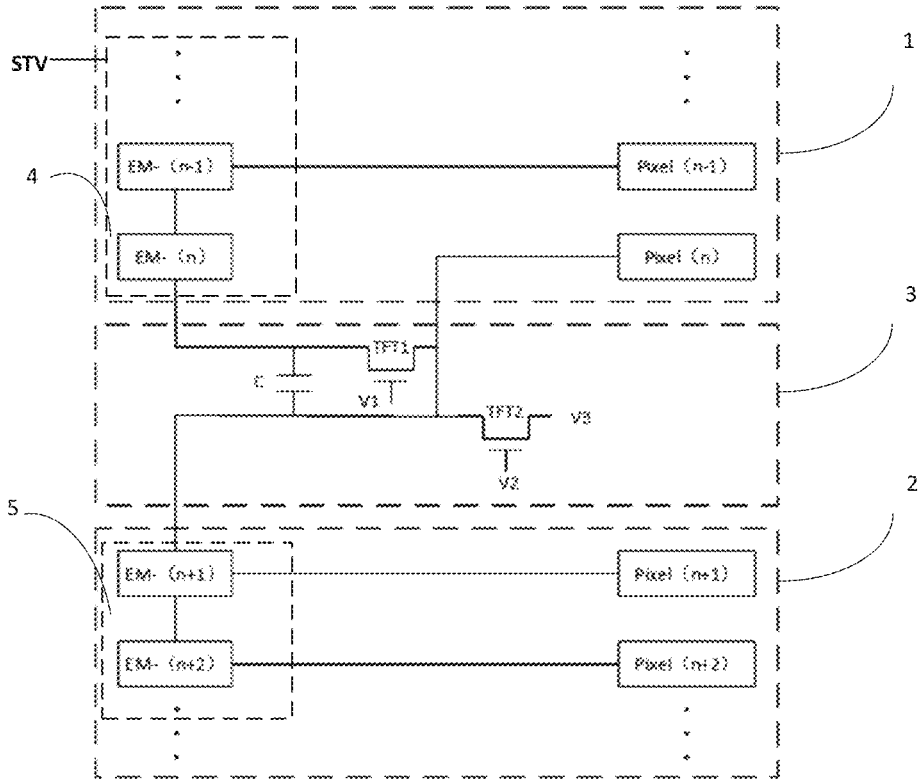
FIG. 5 is a schematic diagram of a part of a structure of a gate driving circuit in an embodiment of the present disclosure, and a corresponding relationship between the gate driving circuit and the display area, and a corresponding relationship between the gate driving circuit and the row of sub-pixels.
Figure 6:
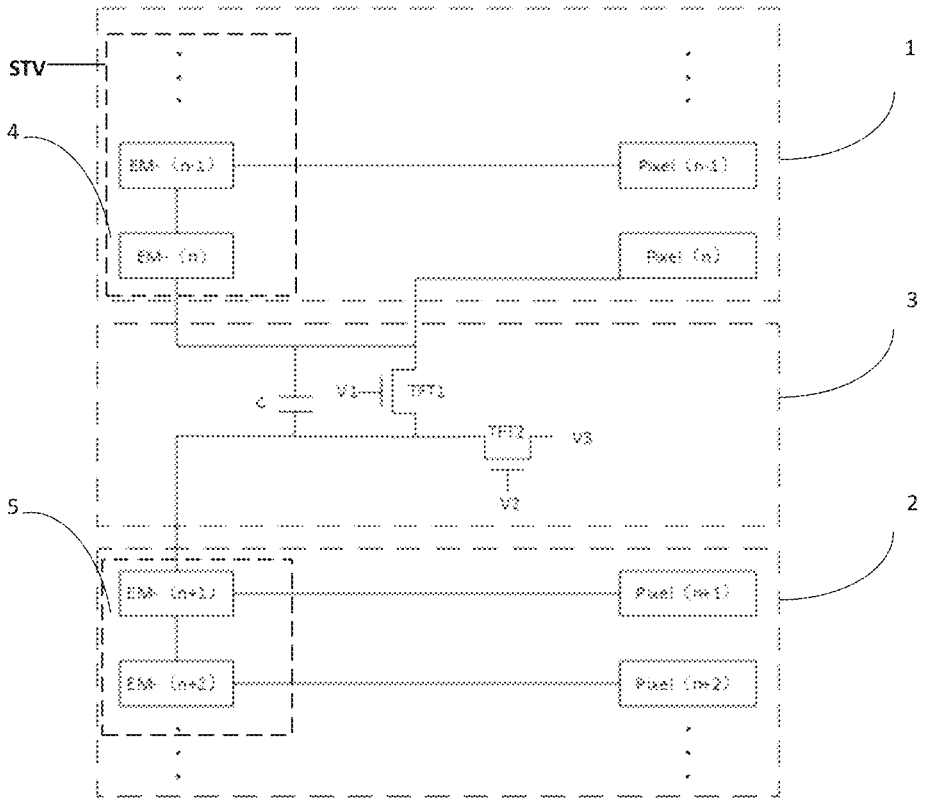
FIG. 6 is a schematic diagram of a part of a structure of a gate driving circuit in an embodiment of the present disclosure, and a corresponding relationship between the gate driving circuit and a display area, and a corresponding relationship between the gate driving circuit and a row of sub-pixels.
Figure 7:
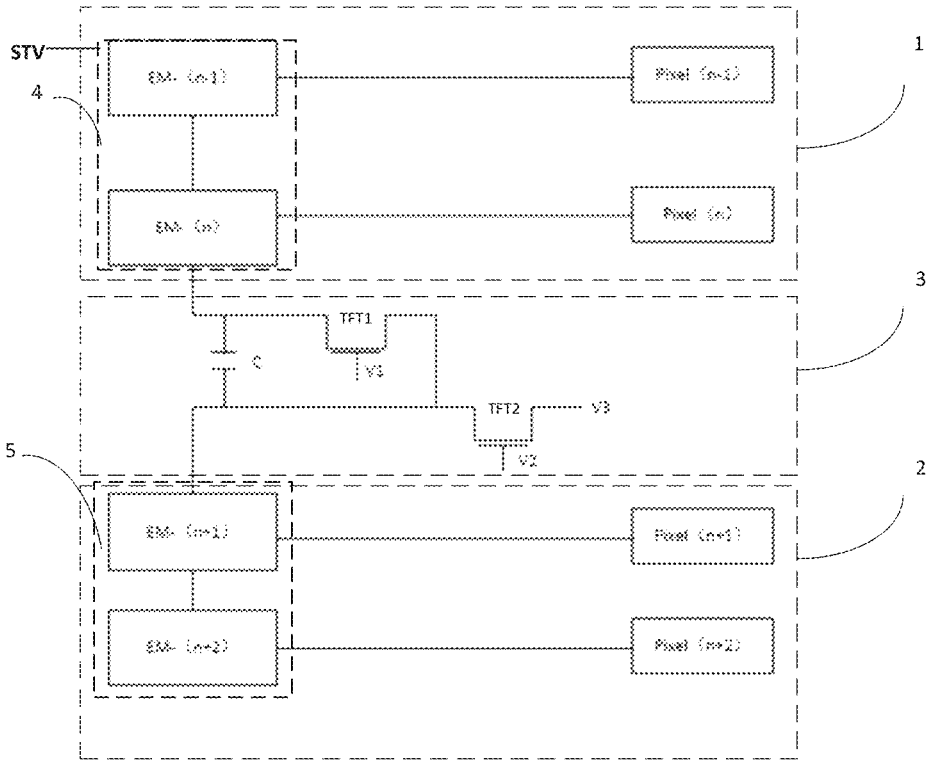
FIG. 7 is a schematic diagram of a part of a structure of a gate driving circuit in an embodiment of the present disclosure, and a corresponding relationship between the gate driving circuit and a display area, and a corresponding relationship between the gate driving circuit and a row of sub-pixels.

An embodiment of the disclosure provides a gate driving circuit, as shown in FIG. 5 to FIG. 7, comprising: a first gate driving sub-circuit 4, a second gate driving sub-circuit 5, a display area control unit 3, and a gate start signal terminal STV.

The first gate driving sub-circuit is electrically coupled to the gate start signal terminal STV, and is electrically coupled to rows of sub-pixels corresponding to the first display area 1 of the display device, for receiving a gate start signal from the gate start signal terminal STV and outputting the gate start signal to the display area control unit, and controlling the first display area 1 to display according to the gate start signal.

The display area control unit 3 is electrically coupled between the first gate driving sub-circuit and the second gate driving sub-circuit, and is used at least for controlling an on-off of an electrical connection between the first gate driving sub-circuit and the second gate driving sub-circuit to control whether to transmit the gate start signal or not, and this gate start signal is a gate start signal output by the gate start signal terminal STV.

The second gate driving sub-circuit is electrically coupled to the display area control unit 3, and is electrically coupled to the rows of sub-pixels corresponding to the second display area 2 of the display device, for controlling a display state of the second display area 2 according to whether the gate start signal is received or not.

The gate driving circuit provided by an embodiment of the present disclosure includes two gate driving sub-circuits for controlling the display conditions of different display areas. The two gate driving sub-circuits are a first gate driving sub-circuit and a second gate driving sub-circuit, respectively. The display area control unit controls a display state of the second display area 2 according to whether the gate start signal is transmitted or not. The first gate driving sub-circuit is at least used to control a display condition of the first display area 1, and the second gate driving sub-circuit is at least used to control a display condition of the second display area 2.

The first gate driving sub-circuit and the second gate driving sub-circuit of the gate driving circuit in an embodiment of the present disclosure share a gate start signal terminal STV, so that when the first display area 1 and the second display area of the display device 2 both perform display functions, a source of the gate start signal received by the two gate driving sub-circuits respectively used to control the first display area 1 and the second display area 2 is the same; and a timing of the gate start signal received by the two gate driving sub-circuits respectively is also the same. The display device does not need to implement special control operations to coordinate the timing relationship between the two display areas, or add corresponding timing adjustment modules, which reduces the control burden of the system and ensures well coordination between the first display area 1 and the second display area of the display device.

Moreover, when two display areas that may be used for partial display are provided in a conventional display device, the technical means of configuring a gate start signal terminal STV for each display area is adopted, so that during a manufacturing process of the display device, it is necessary to detect each gate start signal terminal STV, which increases a complexity of a production process. The technical solutions in the embodiments of the present disclosure may avoid increasing the amount of detection work for the gate start signal terminal STV to a greater extent.

The gate start signal terminal STV in an embodiment of the present disclosure may only be a circuit for transmitting the gate start signal, and does not include a signal source for generating the gate start signal. It may also include a circuit for transmitting the gate start signal and a signal source for generating the gate start signal. The specific design scheme of the gate start signal terminal STV may be a conventional gate start signal terminal STV, which will not be repeated here.

In an optional embodiment of the present disclosure, when the first display area 1 and the second display area 2 both perform display functions, the gate start signal terminal STV outputs the gate start signal to the first gate driving sub-circuit, and the first gate driving sub-circuit outputs the received gate start signal to each row of sub-pixels corresponding to the first gate driving sub-circuit, and the each row of sub-pixels corresponding to the first gate driving sub-circuit displays image based on the gate start signal output by the gate start signal terminal STV. In addition, in a case that a portion of the display area control unit 3 for controlling the on-off of the gate start signal transmission between the first gate driving sub-circuit and the second gate driving sub-circuit is in an on state, the first gate driving sub-circuit outputs the gate start signal to the display area control unit 3, and the display area control unit 3 outputs the gate start signal to the second gate driving sub-circuit. The second gate driving sub-circuit outputs the received gate start signal to each row of sub-pixels corresponding to the second gate driving sub-circuit, so that each row of sub-pixels corresponding to the second gate driving sub-circuit displays image based on the gate start signal output by the gate start signal terminal STV. Therefore, the first display area 1 and the second display area 2 in an embodiment of the present disclosure are both displayed according to the gate start signal output by the same gate start signal terminal STV, which greatly reduces differences in the display conditions between the two display areas caused by the source difference and the waveform difference of the gate start signal, and ensures an image output effect of the display device in a multi-area display phase.

Figure 8:
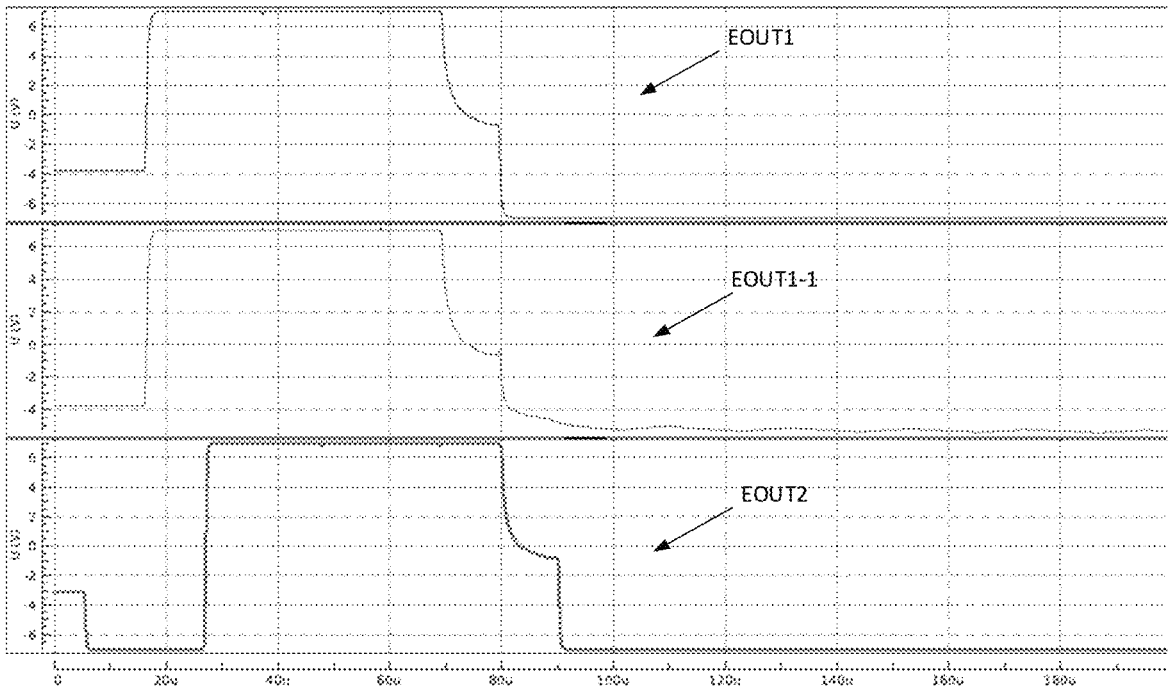
FIG. 8 is schematic diagram of waveforms of EOUT' signals output by a shift register EM-(n) and ESTV2' signals output by a shift register EM-(n+1) of a gate driving circuit in an embodiment of the present disclosure in a multi-area display phase.

In an optional embodiment of the present disclosure, in the multi-area display phase, a shift register EM-(n) in the first gate driving sub-circuit outputs a signal EOUT1 to the corresponding row of sub-pixels Pixel(n), outputs a signal EOUT1−1 to a first shift register EM-(n+1) in the second gate driving sub-circuit, and the first shift register EM-(n+1) in the second gate driving sub-circuit outputs a signal EOUT2 to corresponding row of sub-pixels Pixel (n+1), waveforms of these signals are shown in FIG. 8. It may be seen that waveforms of the signal EOUT1, the signal EOUT1−1, and the signal EOUT2 are substantially the same, and timings of the three signals is also substantially the same. In the multi-area display phase or a full-screen display phase, the gate driving circuit of an embodiment of the present disclosure may eliminate differences of the waveforms of the signals and differences of the timings of signals received by each row of sub-pixels of the first display area 1 and each row of sub-pixels of the second display area 2, so as to reduce the display differences between the first display area 1 and the second display area 2, where n is a positive integer.

When the first display area 1 displays and the second display area 2 does not display, a portion of the display area control unit 3 for controlling the on-off of the signal transmission between the first gate driving sub-circuit and the second gate driving sub-circuit is decoupled, the gate start signal terminal STV outputs the gate start signal to the first gate driving sub-circuit, and the first gate driving sub-circuit outputs the received gate start signal to each row of sub-pixels corresponding to the first gate driving sub-circuit, so that the each row of sub-pixels corresponding to the first gate driving sub-circuit displays image according to the gate start signal output by the gate start signal terminal STV. The display area control unit 3 decoupled a circuit that causes the second gate driving sub-circuit to receive the gate start signal from the first gate driving sub-circuit, and the second gate driving sub-circuit stops receiving the gate start signal output by the gate start signal terminal STV from the first gate driving sub-circuit. Therefore, the second gate driving sub-circuit no longer controls the display state of each row of sub-pixels corresponding to the second gate driving sub-circuit according to the gate start signal generated at the gate start signal terminal STV.

In an optional embodiment of the present disclosure, the first display area 1 and the second display area 2 are adjacent display areas in the display device. Optionally, an attribution of the rows of sub-pixels may be divided according to a light-emitting condition of the rows of sub-pixels and a display condition of the display area. When a certain display area displays and a certain sub-pixel stops receiving the gate start signal, the sub-pixel do not belong to the display area.

Optionally, when the display device corresponding to the gate driving circuit described in an embodiment of the present disclosure is a foldable display device, the boundary between the first display area 1 and the second display area 2 is a folding position of the display device. Optionally, folding and flattening operations of the display device are used to trigger the display area control unit 3 to control the on-off operation of the gate start signal transmission between the first gate driving sub-circuit and the second gate driving sub-circuit. When a relative position of the folding between the first display area 1 and the second display area 2 changes, the display area control unit 3 controls the gate start signal transmission between the first gate driving sub-circuit and the second gate driving sub-circuit to be in an off state, and the second gate driving sub-circuit no longer controls the display condition of the second display area 2 according to the gate start signal output by the gate start signal terminal STV; when a relative position of the flattening between the first display area 1 and the second display area 2 changes, the display area control unit 3 controls the gate start signal transmission between the first gate driving sub-circuit and the second gate driving sub-circuit to be in an on state, and the second gate driving sub-circuit controls the display condition of the second display area 2 according to the gate start signal output by the gate start signal terminal STV.

In an optional embodiment of the present disclosure, the gate driving circuit includes: a first gate driving sub-circuit, a second gate driving sub-circuit, a third gate driving sub-circuit, a first display area control unit, a second display area control unit, and the gate start signal terminal STV. The gate start signal terminal STV is electrically coupled to the first gate driving sub-circuit. The first display area control unit is electrically coupled to the first gate driving sub-circuit and the second gate driving sub-circuit, respectively, for controlling an on-off of an electrical connection between the first gate driving sub-circuit and the second gate driving sub-circuit, to control whether to transmit a gate start signal or not. The second gate driving sub-circuit is electrically coupled to the first display area control unit, and is electrically coupled to rows of sub-pixels corresponding to the second display area of the display device, for controlling a display state of the second display area according to whether the gate start signal is received or not. The second display area control unit is electrically coupled to the second gate driving sub-circuit and the third gate driving sub-circuit, respectively, for controlling an on-off of an electrical connection between the second gate driving sub-circuit and the third gate driving sub-circuit, to control whether to transmit the gate start signal or not. The third gate driving sub-circuit is electrically coupled to the second display area control unit, and is electrically coupled to rows of sub-pixels corresponding to the third display area of the display device, for controlling a display state of the third display area according to whether the gate start signal is received or not; or the second display area control unit is electrically coupled to the first gate driving sub-circuit and the third gate driving sub-circuit, respectively, for controlling an on-off of an electrical connection between the first gate driving sub-circuit and the third gate driving sub-circuit, to control whether to transmit the gate start signal or not.

In an optional embodiment of the present disclosure, the gate driving circuit may further include more gate driving sub-circuits and more display area control units. Optionally, when determining an order relationship of the gate driving sub-circuits, a gate driving sub-circuit electrically coupled to the gate start signal terminal STV is the first gate driving sub-circuit. The second gate driving sub-circuit and the third gate driving sub-circuit may be determined according to the transmission sequence of the gate start signal, or according to the relative positional relationship with the first gate driving sub-circuit on the display device.

In an optional embodiment of the present disclosure, as shown in FIGS. 5 to 7, in the gate driving circuit, each of the first gate driving sub-circuit and the second gate driving sub-circuit includes a plurality of shift registers electrically coupled in sequence. In the first gate driving sub-circuit or the second gate driving sub-circuit, for two shift registers that are adjacent in a start sequence, a signal output terminal of a previous shift register is electrically coupled to a signal input terminal of a next shift register.

A signal input terminal of the display area control unit 3 is electrically coupled to a signal output terminal of a shift register EM-(n) in the first gate driving sub-circuit, and a signal output terminal of the display area control unit 3 is electrically coupled to a signal input terminal of a first shift register EM-(n+1) in the second gate driving sub-circuit. When the signal input terminal and the signal output terminal of the display area control unit 3 are coupled, a gate start signal from the shift register EM-(n) in the first gate driving sub-circuit is transferred to the first shift register EM-(n+1) in the second gate driving sub-circuit.

The shift registers in the first gate driving sub-circuit and the second gate driving sub-circuit may be conventional shift registers. Each shift register is used at least to output a gate start signal to at least one row of sub-pixels, and then control a display condition of the row of sub-pixels according to the gate start signal. Optionally, a first shift register EM-(1) in the first gate driving sub-circuit is electrically coupled to the gate start signal terminal STV. The gate start signal output by the gate start signal terminal STV is output to the first shift register EM-(1) in the first gate driving sub-circuit, and the first shift register EM-(1) in the first gate driving sub-circuit outputs the gate start signal to corresponding row of sub-pixels Pixel(1), and outputs the gate start signal to a second shift register EM-(2) in the first gate driving sub-circuit.

Optionally, in the first gate driving sub-circuit and/or in the second gate driving sub-circuit, a sequence of the shift registers is same as a sequence of a gate start signal transmitting among the shift registers in the gate driving sub-circuit. A shift register directly electrically coupled to the gate start signal terminal STV is the first shift register EM-(1) in the first gate driving sub-circuit.

The signal input terminal of each shift register in an embodiment of the present disclosure is a signal input terminal with a signal input function. The signal input terminal of the first shift register EM-(1) in the first gate driving sub-circuit is electrically coupled to the gate start signal terminal STV, and is at least used to receive the gate start signal from the gate start signal terminal STV. Signal input terminals of the remaining shift registers are at least electrically coupled to a signal output terminal of the previous shift register in an output sequence of the gate start signal, and are at least used to receive the gate start signal output by the previous shift register.

The signal output terminal of each shift register is a signal output terminal with a signal output function. The signal output terminal of each shift register is at least electrically coupled to a signal input terminal of a next shift register in an output sequence of the gate start signal, and is at least used to output the gate start signal to the next shift register.

The signal input terminal of the display area control unit 3 is a signal input terminal with a signal input function. The signal output terminal of the display area control unit 3 is a signal output terminal with a signal output function. When the signal input terminal of the display area control unit 3 and the signal output terminal of the display area control unit 3 are coupled, the signal input terminal of the display area control unit 3 is at least used to receive a gate start signal from the signal output terminal of the shift register electrically coupled to the signal input terminal of the display area control unit 3, and the gate start signal is output to the signal output terminal of the display area control unit 3, and the signal output terminal of the display area control unit 3 outputs the gate start signal to the signal input terminal of the shift register electrically coupled to the signal output terminal of the display area control unit 3. When the signal input terminal of the display area control unit 3 and the signal output terminal of the display area control unit 3 is decoupled, a circuit transmitting the gate start signal from the first gate driving sub-circuit to the second gate driving sub-circuit is decoupled, and the second display area 2 stops displaying according to the gate start signal.

In an optional embodiment of the present disclosure, as shown in FIG. 5, the row of sub-pixels Pixel(n) corresponding to the shift register EM-(n) is electrically coupled to the signal output terminal of the display area control unit 3.

In an embodiment of this disclosure, the "shift register EM-(n)" in the first gate driving sub-circuit is a shift register that is electrically coupled to the display area control unit 3, and outputs a gate start signal to the display area control unit 3. The display area control unit 3 is used to control an on-off of the gate start signal between the first gate driving sub-circuit and the second gate driving sub-circuit, and the display area control unit 3 is also used to control an on-off of the gate start signal between the shift register EM-(n) and the row of sub-pixels Pixel(n) corresponding to the shift register EM-(n).

Optionally, when both the first display area 1 and the second display area 2 display, the row of sub-pixels Pixel(n) corresponding to the shift register EM-(n) receives the gate start signal output by the shift register EM-(n) under control of the display area control unit 3, and performs corresponding display. When the first display area 1 displays and the second display area 2 does not display, the row of sub-pixels Pixel(n) corresponding to the shift register EM-(n) and the second display area 2 stop receiving the gate start signal output by the shift register EM-(n) under control of the display area control unit 3, and stop performing corresponding display.

In an optional embodiment of the present disclosure, the display area control unit 3 includes: a first transistor TFT1, a second transistor TFT2, a split-screen display control signal terminal V1, a half-screen control signal terminal V2, and a display area adjustment signal terminal V3.

A first electrode of the first transistor TFT1 is used as the signal input terminal of the display area control unit 3; a control electrode of the first transistor TFT1 is electrically coupled to the split-screen display control signal terminal V1; a first electrode of the second transistor TFT2 is electrically coupled to the display area adjustment signal terminal V3, a control electrode of the second transistor TFT2 is electrically coupled to the half-screen control signal terminal V2, and a second electrode of the first transistor TFT1 and a second electrode of the second transistor TFT2 are used together as the signal output terminal of the display area control unit 3.

In an embodiment of the present disclosure, the signal output terminal of the shift register EM-(n) is electrically coupled to the first electrode of the first transistor TFT1, and the row of sub-pixels Pixel(n) corresponding to the shift register EM-(n) is electrically coupled to the second electrode of the first transistor TFT1, and the signal input terminal of the first shift register EM-(n+1) in the second gate driving sub-circuit is electrically coupled to the second electrode of the first transistor TFT1.

When the first transistor TFT1 is turned on, a path for outputting the gate start signal output by the signal output terminal of the shift register EM-(n) to the second gate driving sub-circuit and to the row of sub-pixels Pixel(n) corresponding to the shift register EM-(n) is conducted. The second gate driving sub-circuit and the row of sub-pixels Pixel(n) corresponding to the shift register EM-(n) display according to the gate start signal output by the signal output terminal of the shift register EM-(n).

When the first transistor TFT1 is turned off, a path for outputting the gate start signal output by the signal output terminal of the shift register EM-(n) to the second gate driving sub-circuit and to the row of sub-pixels Pixel(n) corresponding to the shift register EM-(n) is decoupled. The second gate driving sub-circuit and the row of sub-pixels Pixel(n) corresponding to the shift register EM-(n) no longer display according to the gate start signal output by the shift register EM-(n).

The on and off states of the first transistor TFT1 are controlled by the split-screen display control signal terminal V1 electrically coupled to the control electrode of the first transistor TFT1. Optionally, when the split-screen display control signal terminal V1 outputs a second signal being at a high level to the control electrode of the first transistor TFT1, the first transistor TFT1 is turned off; when the split-screen display control signal terminal V1 outputs a first control signal being at a low level to the control electrode of the first transistor TFT1, the first transistor TFT1 is turned on. The high or low level of the signal for controlling the on or off of the first transistor TFT1 depends on the type of the first transistor.

A first electrode of the second transistor TFT2 is electrically coupled to the display area adjustment signal terminal V3; a second electrode of the second transistor TFT2 is electrically coupled to the row of sub-pixels Pixel(n) corresponding to the shift register EM-(n), the signal input terminal of the first shift register EM-(n+1) in the second gate driving sub-circuit, and the second electrode of the first transistor TFT1. When the second display area 2 no longer displays, or the first transistor TFT1 is turned off, the second transistor TFT2 is turned on, and an off display signal being at a high level output by the display area adjustment signal terminal V3 is output to the second gate driving sub-circuit and the row of sub-pixels Pixel(n) corresponding to the shift register EM-(n), the second display area 2 corresponding to the second gate driving sub-circuit and the row of sub-pixels Pixel(n) corresponding to the shift register EM-(n) stop displaying.

Alternatively, when the first display area 1 no longer displays and the second display area 2 displays, the first transistor TFT1 is turned off, the second transistor TFT2 is turned on, and the gate start signal output by the display area adjustment signal terminal V3 is output to the second gate driving sub-circuit and the row of sub-pixels Pixel(n) corresponding to the shift register EM-(n), the second display area 2 corresponding to the second gate driving sub-circuit and the row of sub-pixels Pixel(n) corresponding to the shift register EM-(n) display according to a gate start signal output by the display area adjustment signal terminal V3.

The on and off states of the second transistor TFT2 are controlled by the half-screen control signal terminal V2 electrically coupled to the control electrode of the second transistor TFT2. Optionally, when the half-screen control signal terminal V2 outputs a second signal being at a high level to the control electrode of the second transistor TFT2, the second transistor TFT2 is turned off; when the half-screen control signal terminal V2 outputs a first control signal being at a low level to the control electrode of the second transistor TFT2, the second transistor TFT2 is turned on. The high or low level of the signal for controlling the on or off of the second transistor TFT2 depends on the type of the second transistor.

In an optional embodiment of the present disclosure, as shown in FIG. 6, the row of sub-pixels Pixel(n) corresponding to the shift register EM-(n) is electrically coupled to the signal output terminal of the shift register EM-(n).

In an embodiment of this disclosure, the "shift register EM-(n)" is a shift register in the first gate driving sub-circuit that is electrically coupled to the display area control unit 3 and outputs a gate start signal to the display area control unit 3. The shift register EM-(n) is a shift register in the first gate driving sub-circuit corresponding to the first display area 1. The shift register EM-(n) is electrically coupled to the display area control unit 3 through the signal output terminal of the shift register EM-(n), and the shift register EM-(n) is electrically coupled to the row of sub-pixels Pixel(n) corresponding to the shift register EM-(n) through the signal output terminal of the shift register EM-(n). The signal output terminal of the shift register EM-(n) is used to output a signal to the signal input terminal of the display area control unit 3 and also to output a signal to the corresponding row of sub-pixels Pixel(n).

Optionally, in the first gate driving sub-circuit and/or the second gate driving sub-circuit, each shift register has same structure, an arrangement of the signal terminals, and the connection relationships of the corresponding rows of sub-pixels as the shift register EM-(n).

Optionally, when both the first display area 1 and the second display area 2 display, the gate start signal output by the signal output terminal of the shift register EM-(n) is output to the corresponding row of sub-pixels Pixel(n) and the signal input terminal of the display area control unit 3. The display area control unit 3 outputs the gate start signal to the second gate driving sub-circuit, and the first display area 1 and the second display area 2 performs the display functions according to the gate start signal from the gate start signal terminal STV. When the first display area 1 displays and the second display area 2 does not display, each row of sub-pixels (including the row of sub-pixels Pixel(n) corresponding to the shift register EM-(n)) in the first display area performs a display function according to the gate start signal from the gate start signal terminal STV, and the second display area 2 does not perform the display function according to the gate start signal from the gate start signal terminal STV.

In an optional embodiment of the present disclosure, the display area control unit 3 includes: a first transistor TFT1, a second transistor TFT2, a split-screen display control signal terminal V1, a half-screen control signal terminal V2, and a display area adjustment signal terminal V3.

A first electrode of the first transistor TFT1 is used as the signal input terminal of the display area control unit 3; a control electrode of the first transistor TFT1 is electrically coupled to the split-screen display control signal terminal V1; a first electrode of the second transistor TFT2 is electrically coupled to the display area adjustment signal terminal V3; a control electrode of the second transistor TFT2 is electrically coupled to the half-screen control signal terminal V2; and a second electrode of the first transistor TFT1 and a second electrode of the second transistor TFT2 are used together as the signal output terminal of the display area control unit 3.

In an embodiment of the present disclosure, the signal output terminal of the shift register EM-(n) is electrically coupled to the first electrode of the first transistor TFT1 and the row of sub-pixels Pixel(n) corresponding to the shift register EM-(n), respectively. The second electrode of the first transistor TFT1 is electrically coupled to the signal input terminal of the first shift register EM-(n+1) in the second gate driving sub-circuit.

When the first transistor TFT1 is turned on, a path for outputting the gate start signal output by the signal output terminal of the shift register EM-(n) to the second gate driving sub-circuit is conducted. Each row of sub-pixels corresponding to the second gate driving sub-circuit and each row of sub-pixels corresponding to the first gate driving sub-circuit display according to the gate start signal.

When the first transistor TFT1 is turned off, a path for outputting the gate start signal output by the signal output terminal of the shift register EM-(n) to the second gate driving sub-circuit is decoupled. The second gate driving sub-circuit no longer displays according to the gate start signal. In an embodiment of the present disclosure, an electrical connection relationship between the row of sub-pixels Pixel(n) corresponding to the shift register EM-(n) and the shift register EM-(n) is no longer controlled by the display area control unit 3. When the first display area 1 displays, the row of sub-pixels Pixel(n) corresponding to the shift register EM-(n) also displays.

The on and off states of the first transistor TFT1 are controlled by the split-screen display control signal terminal V1 electrically coupled to the control electrode of the first transistor TFT1. Optionally, when the split-screen display control signal terminal V1 outputs a second signal being at a high level to the control electrode of the first transistor TFT1, the first transistor TFT1 is turned off; when the split-screen display control signal terminal V1 outputs a second signal being at a low level to the control electrode of the first transistor TFT1, the first transistor TFT1 is turned on. The high or low level of the signal for controlling the on or off of the first transistor TFT1 depends on the type of the first transistor. Optionally, the first transistor TFT1 may be a P-type transistor or an N-type transistor.

The first electrode of the second transistor TFT2 is electrically coupled to the display area adjustment signal terminal V3, the second electrode of the second transistor TFT2 is electrically coupled to the second electrode of the first transistor TFT1 and a first electrode of a first shift register EM-(n+1) in the second gate driving sub-circuit. When the second display area 2 no longer displays, or the first transistor TFT1 is turned off, the second transistor TFT2 is turned on, and an off display signal being at a high level output by the display area adjustment signal terminal V3 is output to the second gate driving sub-circuit, and the second display area 2 stops displaying.

In a multi-area display phase, a shift register EM-(n) in the first gate driving sub-circuit outputs a signal EOUT1 to the corresponding row of sub-pixels Pixel(n), outputs a signal EOUT1−1 to a first shift register EM-(n+1) in the second gate driving sub-circuit; and the first shift register EM-(n+1) in the second gate driving sub-circuit outputs a signal EOUT2 to corresponding row of sub-pixels Pixel (n+1), waveforms of these signals are shown in FIG. 8. It may be seen that waveforms of the signal EOUT1, the signal EOUT1−1, and the signal EOUT2 are substantially the same, and timings of the three signals is also substantially the same. In the multi-area display phase or a full-screen display phase, the gate driving circuit of an embodiment of the present disclosure may eliminate differences of the waveforms of the signals and differences of the timings of signals received by each row of sub-pixels of the first display area 1 and each row of sub-pixels of the second display area 2, so as to reduce the display differences between the first display area 1 and the second display area 2.

Figure 9:
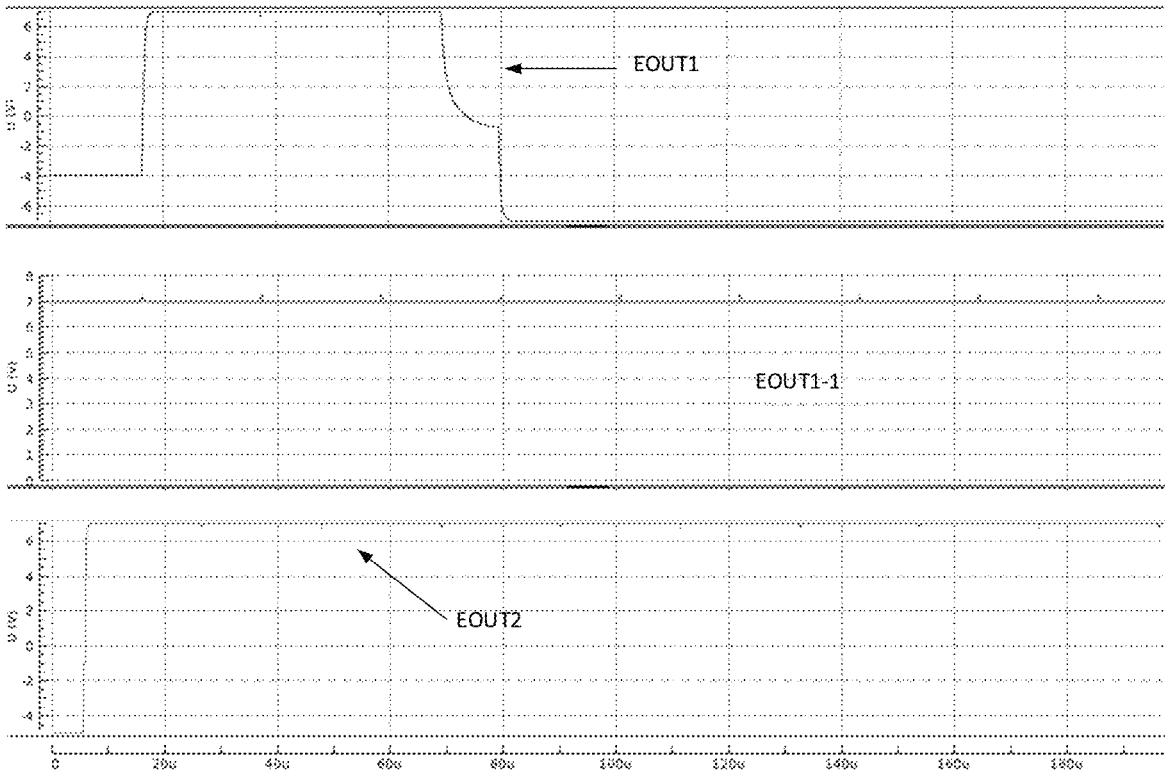
FIG. 9 is a schematic diagram of waveforms of EOUT' signals output by a shift register EM-(n) and ESTV2' signals output by a shift register EM-(n+1) of a gate driving circuit in an embodiment of the present disclosure in a partial display phase.

In a partial display phase or the split-screen display phase, a shift register EM-(n) outputs a signal EOUT1 to the corresponding row of sub-pixels Pixel(n), outputs a signal EOUT1−1 to a first shift register EM-(n+1) in the second gate driving sub-circuit; and the first shift register EM-(n+1) in the second gate driving sub-circuit outputs a signal EOUT2 to the corresponding row of sub-pixels Pixel (n+1), waveforms of these signals are shown in FIG. 9. It may be seen that in the partial display phase, the second display area 2 does not display, the second display area 2 does not receive the gate start signal, and the corresponding EOUT1−1 has no effective waveform display. At this time, the signal EOUT2 output by the first shift register EM-(n+1) in the second gate driving sub-circuit to the corresponding row of sub-pixels is an off display signal being at a high level output by the display area adjustment signal terminal V3.

Alternatively, when the first display area 1 no longer displays and the second display area 2 displays, the first transistor TFT1 is turned off, the second transistor TFT2 is turned on, and the gate start signal output by the display area adjustment signal terminal V3 is output to the second gate driving sub-circuit, and the second display area 2 displays.

The on and off states of the second transistor TFT2 are controlled by the half-screen control signal terminal V2 electrically coupled to the control electrode of the second transistor TFT2. Optionally, when the half-screen control signal terminal V2 outputs a second signal being at a high level to the control electrode of the second transistor TFT2, the second transistor TFT2 is turned off; when the half-screen control signal terminal V2 outputs a first control signal being at a low level to the control electrode of the second transistor TFT2, the second transistor TFT2 is turned on. The high or low level of the signal for controlling the on or off of the second transistor TFT2 depends on the type of the second transistor.

In an optional embodiment of the present disclosure, as shown in FIG. 7, the row of sub-pixels Pixel(n) corresponding to the shift register EM-(n) is electrically coupled to a second signal output terminal of the shift register EM-(n).

In an embodiment of this disclosure, the "shift register EM-(n)" is a shift register that is electrically coupled to the display area control unit 3 in the first gate driving sub-circuit and outputs a gate start signal to the display area control unit 3. The shift register EM-(n) is a shift register in the first gate driving sub-circuit corresponding to the first display area 1. The shift register EM-(n) is electrically coupled to the display area control unit 3 through the signal output terminal of the shift register EM-(n), and the shift register EM-(n) is electrically coupled to the row of sub-pixels Pixel(n) corresponding to the shift register EM-(n) through the second signal output terminal of the shift register EM-(n). The signal output terminal of the shift register EM-(n) is used to output a gate start signal to the display area control unit 3, and the second signal output terminal of the shift register EM-(n) is used to output a gate start signal to the row of sub-pixels Pixel(n) corresponding to the shift register EM-(n).

Optionally, when the first display area 1 and the second display area 2 perform the display function together, the row of sub-pixels Pixel(n) corresponding to the shift register EM-(n) receives the gate start signal output by the second signal output terminal of the shift register EM-(n) and performs corresponding display. The second gate driving sub-circuit receives the gate start signal output by the signal output terminal of the shift register EM-(n) under control of the display area control unit 3 and performs corresponding display. When the first display area 1 displays and the second display area 2 does not display, the row of sub-pixels Pixel(n) corresponding to the shift register EM-(n) receives the gate start signal output by the shift register EM-(n) and performs corresponding display; and the second gate driving sub-circuit, under control of the display area control unit 3, stops receiving the gate start signal output by the signal output terminal of the shift register EM-(n) and stops performing corresponding display according to the gate start signal.

In an optional embodiment of the present disclosure, the display area control unit 3 includes: a first transistor TFT1, a second transistor TFT2, a split-screen display control signal terminal V1, a half-screen control signal terminal V2, and a display area adjustment signal terminal V3.

A first electrode of the first transistor TFT1 is used as the signal input terminal of the display area control unit 3; a control electrode of the first transistor TFT1 is electrically coupled to the split-screen display control signal terminal V1; a first electrode of the second transistor TFT2 is coupled to the display area adjustment signal terminal V3; a control electrode of the second transistor TFT2 is electrically coupled to the half-screen control signal terminal V2; and a second electrode of the first transistor TFT1 and a second electrode of the second transistor TFT2 are used together as the signal output terminal of the display area control unit 3.

In an embodiment of the present disclosure, the signal output terminal of the shift register EM-(n) is electrically coupled to the first electrode of the first transistor TFT1. The second signal output terminal of the shift register EM-(n) is electrically coupled to the row of sub-pixels Pixel(n) corresponding to the shift register EM-(n). The signal output terminal of the shift register EM-(n) and the second signal output terminal of the shift register EM-(n) are both signal output terminals with a signal output function.

When the first transistor TFT1 is turned on, a path for outputting the gate start signal output by the signal output terminal of the shift register EM-(n) to the second gate driving sub-circuit is conducted. Each row of sub-pixels corresponding to the second gate driving sub-circuit and each row of sub-pixels corresponding to the first gate driving sub-circuit display according to the gate start signal.

When the first transistor TFT1 is turned off, a path for outputting the gate start signal output by the signal output terminal of the shift register EM-(n) to the second gate driving sub-circuit is decoupled. The second gate driving sub-circuit does not display according to the gate start signal output by the shift register EM-(n). In an embodiment of the present disclosure, an electrical connection between the row of sub-pixels Pixel(n) corresponding to the shift register EM-(n) and the shift register EM-(n) is controlled by the second signal output terminal of the shift register EM-(n), and a display condition of the row of sub-pixels Pixel(n) corresponding to the shift register EM-(n) may no longer be affected by the display area control unit 3.

The on and off states of the first transistor TFT1 are controlled by the split-screen display control signal terminal V1 electrically coupled to the control electrode of the first transistor TFT1. Optionally, when the split-screen display control signal terminal V1 outputs a second signal being at a high level to the control electrode of the first transistor TFT1, the first transistor TFT1 is turned off; when the split-screen display control signal terminal V1 outputs a first control signal being at a low level to the control electrode of the first transistor TFT1, the first transistor TFT1 is turned on. The high or low level of the signal for controlling the on or off of the first transistor TFT1 depends on the type of the first transistor.

The first electrode of the second transistor TFT2 is electrically coupled to the display area adjustment signal terminal V3, the second electrode of the second transistor TFT2 is electrically coupled to the second electrode of the first transistor TFT1 and to the signal input terminal of the first shift register EM-(n+1) in the second gate driving sub-circuit. When the second display area 2 no longer displays, or the first transistor TFT1 is turned off, the second transistor TFT2 is turned on, and an off display signal being at a high level output by the display area adjustment signal terminal V3 is output to the second gate driving sub-circuit, and the second display area 2 stops displaying.

In a multi-area display phase, a shift register EM-(n) in the first gate driving sub-circuit outputs a signal EOUT1 to the corresponding row of sub-pixels Pixel(n), outputs a signal EOUT1−1 to a first shift register EM-(n) in the second gate driving sub-circuit, and the first shift register EM-(n+1) in the second gate driving sub-circuit outputs a signal EOUT2 to corresponding row of sub-pixels Pixel (n+1), and waveforms of these signals are shown in FIG. 8. It may be seen that waveforms of the signal EOUT1, the signal EOUT1−1, and the signal EOUT2 are substantially the same, and timings of the three signals is also substantially the same. In the multi-area display phase or a full-screen display phase, the gate driving circuit of an embodiment of the present disclosure may eliminate differences of the waveforms of the signals and differences of the timings of signals received by each row of sub-pixels of the first display area 1 and each row of sub-pixels of the second display area 2, so as to reduce the display differences between the first display area 1 and the second display area 2.

In a partial display phase, a shift register EM-(n) outputs a signal EOUT1 to the corresponding row of sub-pixels Pixel(n), outputs a signal EOUT1−1 to a first shift register EM-(n+1) in the second gate driving sub-circuit, and the first shift register EM-(n+1) in the second gate driving sub-circuit outputs a signal EOUT2 to the corresponding row of sub-pixels, and waveforms of these signals are shown in FIG. 9. It may be seen that in the partial display phase, the second display area 2 does not display, the second display area 2 does not receive the gate start signal, and the corresponding EOUT1−1 has no effective waveform display. At this time, the signal EOUT2 output by the first shift register EM-(n+1) in the second gate driving sub-circuit to the corresponding row of sub-pixels is an off display signal output by the display area adjustment signal terminal V3, the off display signal is a signal being at a high level in this embodiment.

Alternatively, when the first display area 1 no longer displays and the second display area 2 displays, the first transistor TFT1 is turned off, the second transistor TFT2 is turned on, and the gate start signal output by the display area adjustment signal terminal V3 is output to the second gate driving sub-circuit, and the second display area 2 corresponding to the second gate driving sub-circuit displays.

The on and off states of the second transistor TFT2 are controlled by the half-screen control signal terminal V2 electrically coupled to the control electrode of the second transistor TFT2. Optionally, when the half-screen control signal terminal V2 outputs a second signal being at a high level to the control electrode of the second transistor TFT2, the second transistor TFT2 is turned off; when the half-screen control signal terminal V2 outputs a first control signal being at a low level to the control electrode of the second transistor TFT2, the second transistor TFT2 is turned on. The high or low level of the signal for controlling the on or off of the second transistor TFT2 depends on the type of the second transistor.

In an optional embodiment of the present disclosure, the first gate driving sub-circuit and the second gate driving sub-circuit each include a plurality of shift registers electrically coupled in sequence.

The signal input terminal of the display area control unit 3 is electrically coupled to the signal output terminal of the shift register EM-(n) in the first gate driving sub-circuit, and the signal output terminal of the display area control unit 3 is electrically coupled to the signal input terminal of the first shift register EM-(n+1) in the second gate driving sub-circuit. When the signal input terminal of the display area control unit 3 and the signal output terminal of the display area control unit 3 are coupled, the gate start signal from the shift register EM-(n) in the first gate driving sub-circuit is transferred to the first shift register EM-(n+1) in the second gate driving sub-circuit.

In each of shift registers in the first gate driving sub-circuit except the shift register EM-(n) or in shift registers in the second gate driving sub-circuit, for two shift registers that are adjacent in a start sequence, a signal output terminal of a previous shift register is electrically coupled to a signal input terminal of a next shift register.

The shift registers in the first gate driving sub-circuit and the second gate driving sub-circuit may be conventional shift registers. Each shift register is used at least to output a gate start signal to at least one row of sub-pixels, and then control a display condition of the row of sub-pixels according to the gate start signal. Optionally, a first shift register EM-(1) in the first gate driving sub-circuit is electrically coupled to the gate start signal terminal STV. The gate start signal output by the gate start signal terminal STV is output to the first shift register EM-(1) in the first gate driving sub-circuit, and the first shift register EM-(1) in the first gate driving sub-circuit outputs the gate start signal to corresponding row of sub-pixels Pixel(1), and outputs the gate start signal to a second shift register EM-(2) in the first gate driving sub-circuit.

Optionally, in the first gate driving sub-circuit and/or in the second gate driving sub-circuit, a sequence of the shift registers is same as a sequence of a gate start signal transmitting among the shift registers in the gate driving sub-circuit. A shift register directly electrically coupled to the gate start signal terminal STV is the first shift register in the first gate driving sub-circuit.

The signal input terminal of each shift register in an embodiment of the present disclosure is a signal input terminal with a signal input function. The signal input terminal of the first shift register EM-(1) in the first gate driving sub-circuit is electrically coupled to a gate start signal terminal STV, and is at least used to receive the gate start signal from the gate start signal terminal STV. The signal input terminals of the remaining shift registers are at least electrically coupled to the signal output terminal of a previous shift register in an output sequence of the gate start signal, and are at least used to receive the gate start signal output by the previous shift register. The signal output terminal of each shift register is a signal output terminal with a signal output function. The signal output terminal of each shift register is at least electrically coupled to a signal input terminal of a next shift register in an output sequence of the gate start signal, and is at least used to output the gate start signal to the next shift register. The second signal output terminal of each shift register is a signal output terminal with a signal output function. The second signal output terminal of each shift register is electrically coupled to at least the row of sub-pixels corresponding to the shift register, and is used to output the gate start signal to the row of sub-pixels.

The signal input terminal of the display area control unit 3 is a signal input terminal with a signal input function. The signal output terminal of the display area control unit 3 is a signal output terminal with a signal output function. When the signal input terminal of the display area control unit 3 and the signal output terminal of the display area control unit 3 are coupled, the signal input terminal of the display area control unit 3 is at least used to receive a gate start signal from the signal output terminal of the shift register electrically coupled to the signal input terminal of the display area control unit 3, and the gate start signal is output to the signal output terminal of the display area control unit 3, and the signal output terminal of the display area control unit 3 outputs the gate start signal to the signal input terminal of the shift register electrically coupled to the signal output terminal of the display area control unit 3. When the signal input terminal of the display area control unit 3 and the signal output terminal of the display area control unit 3 is decoupled, a circuit transmitting the gate start signal from the first gate driving sub-circuit to the second gate driving sub-circuit is decoupled, and the second display area 2 stops displaying according to the gate start signal.

In an optional embodiment of the present disclosure, the row of sub-pixels Pixel(n) corresponding to the shift register EM-(n) is electrically coupled to the signal output terminal of the display area control unit 3.

In an embodiment of this disclosure, the "shift register EM-(n)" in the first gate driving sub-circuit is a shift register that is electrically coupled to the display area control unit 3, and outputs a gate start signal to the display area control unit 3. The display area control unit 3 is used to control an on-off of the gate start signal between the first gate driving sub-circuit and the second gate driving sub-circuit, and the display area control unit 3 is also used to control an on-off of the gate start signal between the shift register EM-(n) and the row of sub-pixels Pixel(n) corresponding to the shift register EM-(n).

Optionally, when both the first display area 1 and the second display area 2 display, the row of sub-pixels Pixel(n) corresponding to the shift register EM-(n) and the second display area 2 receive the gate start signal output by the shift register EM-(n) under control of the display area control unit 3, and perform corresponding display. When the first display area 1 displays and the second display area 2 does not display, the row of sub-pixels Pixel(n) corresponding to the shift register EM-(n) stops receiving the gate start signal output by the shift register EM-(n) under control of the display area control unit 3, and stops performing corresponding display.

In an optional embodiment of the present disclosure, the display area control unit 3 includes: a first transistor TFT1, a second transistor TFT2, a split-screen display control signal terminal V1, a half-screen control signal terminal V2, and a display area adjustment signal terminal V3.

A first electrode of the first transistor TFT1 is used as the signal input terminal of the display area control unit 3; a control electrode of the first transistor TFT1 is electrically coupled to the split-screen display control signal terminal V1; a first electrode of the second transistor TFT2 is electrically coupled to the display area adjustment signal terminal V3; a control electrode of the second transistor TFT2 is electrically coupled to the half-screen control signal terminal V2; and a second electrode of the first transistor TFT1 and a second electrode of the second transistor TFT2 are used together as the signal output terminal of the display area control unit 3.

In an embodiment of the present disclosure, the signal output terminal of the shift register EM-(n) is electrically coupled to the first electrode of the first transistor TFT1. The row of sub-pixels Pixel(n) corresponding to the shift register EM-(n) is electrically coupled to the second electrode of the first transistor TFT1, and a signal input terminal of a first shift register EM-(n+1) in the second gate driving sub-circuit is electrically coupled to the second electrode of the first transistor TFT1.

When the first transistor TFT1 is turned on, a path for outputting the gate start signal output by the signal output terminal of the shift register EM-(n) to the second gate driving sub-circuit and to the row of sub-pixels Pixel(n) corresponding to the shift register EM-(n) is conducted. The second gate driving sub-circuit and the row of sub-pixels Pixel(n) corresponding to the shift register EM-(n) display according to the gate start signal output by the shift register EM-(n).

When the first transistor TFT1 is turned off, a path for outputting the gate start signal output by the signal output terminal of the shift register EM-(n) to the second gate driving sub-circuit and to the row of sub-pixels Pixel(n) corresponding to the shift register EM-(n) is decoupled. The second gate driving sub-circuit and the row of sub-pixels Pixel(n) corresponding to the shift register EM-(n) no longer display according to the gate start signal. In an embodiment of the present disclosure, an electrical connection relationship between the row of sub-pixels Pixel(n) corresponding to the shift register EM-(n) and the shift register EM-(n) is controlled by the display area control unit 3.

The on and off states of the first transistor TFT1 are controlled by the split-screen display control signal terminal V1 electrically coupled to the control electrode of the first transistor TFT1. Optionally, when the split-screen display control signal terminal V1 outputs a second signal being at a high level to the control electrode of the first transistor TFT1, the first transistor TFT1 is turned off; when the split-screen display control signal terminal V1 outputs a first control signal being at a low level to the control electrode of the first transistor TFT1, the first transistor TFT1 is turned on. The high or low level of the signal for controlling the on or off of the first transistor TFT1 depends on the type of the first transistor. Optionally, the first transistor TFT1 may be a P-type transistor or an N-type transistor.

The first electrode of the second transistor TFT2 is electrically coupled to the display area adjustment signal terminal V3; a second electrode of the second transistor TFT2 is electrically coupled to the row of sub-pixels Pixel (n) corresponding to the shift register EM-(n) and the second electrode of the first transistor TFT1. When the second display area 2 no longer displays, or the first transistor TFT1 is turned off, the second transistor TFT2 is turned on, and an off display signal being at a high level output by the display area adjustment signal terminal V3 is output to the second gate driving sub-circuit and the row of sub-pixels Pixel(n) corresponding to the shift register EM-(n), and the second gate driving sub-circuit and the row of sub-pixels Pixel(n) corresponding to the shift register EM-(n) stop displaying.

Alternatively, when the first display area 1 no longer displays and the second display area 2 displays, the first transistor TFT1 is turned off, the second transistor TFT2 is turned on, and the gate start signal output by the display area adjustment signal terminal V3 is output to the second gate driving sub-circuit and the row of sub-pixels Pixel(n) corresponding to the shift register EM-(n), the second gate driving sub-circuit and the row of sub-pixels Pixel (n) corresponding to the shift register EM-(n) display.

The on and off states of the second transistor TFT2 are controlled by the half-screen control signal terminal V2 electrically coupled to the control electrode of the second transistor TFT2. Optionally, when the half-screen control signal terminal V2 outputs a second signal being at a high level to the control electrode of the second transistor TFT2, the second transistor TFT2 is turned off; when the half-screen control signal terminal V2 outputs a first control signal being at a low level to the control electrode of the second transistor TFT2, the second transistor TFT2 is turned on. The high or low level of the signal for controlling the on or off of the second transistor TFT2 depends on the type of the second transistor. Optionally, the second transistor TFT2 may be a P-type transistor or an N-type transistor.

In an optional embodiment of the present disclosure, the row of sub-pixels Pixel(n) corresponding to the shift register EM-(n) is electrically coupled to a second signal output terminal of the shift register EM-(n).

In an embodiment of this disclosure, the "shift register EM-(n)" in the first gate driving sub-circuit is a shift register that is electrically coupled to the display area control unit 3 and outputs a gate start signal to the display area control unit 3. The display area control unit 3 is used to control an on-off of the gate start signal between the first gate driving sub-circuit and the second gate driving sub-circuit.

Optionally, when both the first display area 1 and the second display area 2 display, the second gate driving sub-circuit and the row of sub-pixels Pixel(n) corresponding to the shift register EM-(n) receive the gate start signal output by the second signal output terminal of the shift register EM-(n), and perform corresponding display. When the first display area 1 displays and the second display area 2 does not display, the row of sub-pixels Pixel(n) corresponding to the shift register EM-(n) receives the gate start signal output by the second signal output terminal of the shift register EM-(n), and performs corresponding display. The second display area 2 stops receiving the gate start signal output by the second signal output terminal of the shift register EM-(n), and stops performing corresponding display.

In an optional embodiment of the present disclosure, the display area control unit 3 includes: a first transistor TFT1, a second transistor TFT2, a split-screen display control signal terminal V1, a half-screen control signal terminal V2, and a display area adjustment signal terminal V3.

A first electrode of the first transistor TFT1 is used as the signal input terminal of the display area control unit 3; a control electrode of the first transistor TFT1 is electrically coupled to the split-screen display control signal terminal V1; a first electrode of the second transistor TFT2 is coupled to the display area adjustment signal terminal V3; a control electrode of the second transistor TFT2 is electrically coupled to the half-screen control signal terminal V2; and a second electrode of the first transistor TFT1 and a second electrode of the second transistor TFT2 are used together as the signal output terminal of the display area control unit 3.

In an embodiment of the present disclosure, the second signal output terminal of the shift register EM-(n) is electrically coupled to the first electrode of the first transistor TFT1, and the row of sub-pixels Pixel (n) corresponding to the shift register EM-(n), respectively. The second electrode of the first transistor TFT1 is electrically coupled to the signal input terminal of the first shift register EM-(n+1) in the second gate driving sub-circuit and the second electrode of the second transistor TFT2, respectively.

When the first transistor TFT1 is turned on, a path for outputting the gate start signal output by the second signal output terminal of the shift register EM-(n) to the second gate driving sub-circuit is conducted. Each row of sub-pixels corresponding to the second gate driving sub-circuit and each row of sub-pixels corresponding to the first gate driving sub-circuit display according to the gate start signal.

When the first transistor TFT1 is turned off, a path for outputting the gate start signal output by the second signal output terminal of the shift register EM-(n) to the second gate driving sub-circuit is decoupled. The second gate driving sub-circuit does not display according to the gate start signal output by the second signal output terminal of the shift register EM-(n), and an electrical connection state between the second signal output terminal of the shift register EM-(n) and the corresponding row of sub-pixels Pixel(n) remains unchanged, and the corresponding row of sub-pixels Pixel(n) continues to display according to the gate start signal output by the second signal output terminal of the shift register EM-(n). In an embodiment of the present disclosure, an electrical connection relationship between the row of sub-pixels Pixel(n) corresponding to the shift register EM-(n) and the shift register EM-(n) is no longer controlled by the display area control unit 3. When the first display area 1 displays, the row of sub-pixels Pixel(n) corresponding to the shift register EM-(n) also displays.

The on and off states of the first transistor TFT1 are controlled by the split-screen display control signal terminal V1 electrically coupled to the control electrode of the first transistor TFT1. Optionally, when the split-screen display control signal terminal V1 outputs a second signal being at a high level to the control electrode of the first transistor TFT1, the first transistor TFT1 is turned off; when the split-screen display control signal terminal V1 outputs a first control signal being at a low level to the control electrode of the first transistor TFT1, the first transistor TFT1 is turned on. The high or low level of the signal for controlling the on or off of the first transistor TFT1 depends on the type of the first transistor. Optionally, the first transistor TFT1 may be a P-type transistor or an N-type transistor.

The first electrode of the second transistor TFT2 is electrically coupled to the display area adjustment signal terminal V3, the second electrode of the second transistor TFT2 is electrically coupled to the second electrode of the first transistor TFT1, and a first electrode of the first shift register EM-(n+1) in the second gate driving sub-circuit. When the second display area 2 no longer displays, or the first transistor TFT1 is turned off, the second transistor TFT2 is turned on, and an off display signal being at a high level output by the display area adjustment signal terminal V3 is output to the second gate driving sub-circuit, and the second display area 2 stops displaying.

In a multi-area display phase, the second signal output terminal of the shift register EM-(n) outputs a signal EOUT1 to the corresponding row of sub-pixels Pixel(n), outputs a signal EOUT1−1 to a first shift register EM-(n+1) in the second gate driving sub-circuit through the display area control unit 3, and the first shift register EM-(n+1) in the second gate driving sub-circuit outputs a signal EOUT2 to corresponding row of sub-pixels Pixel (n+1), waveforms of these signals are shown in FIG. 8. It may be seen that in the multi-area display phase, both the first display area 1 and the second display area 2 display, and the waveforms of the signal EOUT1, the signal EOUT1−1, and the signal EOUT2 are substantially the same, so differences of waveforms of received signals between each row of sub-pixels in the first display area and each row of sub-pixels in the second display area are greatly reduced.

In a partial display phase, the second signal output terminal of the shift register EM-(n) outputs a signal EOUT1 to the corresponding row of sub-pixels, outputs a signal EOUT1−1 to a first shift register EM-(n+1) in the second gate driving sub-circuit through the display area control unit 3, and the first shift register EM-(n+1) in the second gate driving sub-circuit outputs a signal EOUT2 to corresponding row of sub-pixels Pixel (n+1), waveforms of these signals are shown in FIG. 9. It may be seen that in the partial display phase, the second display area 2 does not display, and the second display area 2 does not receive the signal output by the shift register EM-(n), and the corresponding EOUT1−1 has no effective waveform display. The signal EOUT2 output by the first shift register EM-(n+1) in the second gate driving sub-circuit to the corresponding row of sub-pixels Pixel(n+1) is an off display signal output by the display area adjustment signal terminal V3, and the off display signal is a signal being at a high level in this embodiment.

Alternatively, when the first display area 1 no longer displays and the second display area 2 displays, the first transistor TFT1 is turned off, the second transistor TFT2 is turned on, and the gate start signal output by the display area adjustment signal terminal V3 is output to the second gate driving sub-circuit, and the row of sub-pixels corresponding to the second gate driving sub-circuit displays.

The on and off states of the second transistor TFT2 are controlled by the half-screen control signal terminal V2 electrically coupled to the control electrode of the second transistor TFT2. Optionally, when the half-screen control signal terminal V2 outputs a second signal being at a high level to the control electrode of the second transistor TFT2, the second transistor TFT2 is turned off; when the half-screen control signal terminal V2 outputs a second signal being at a low level to the control electrode of the second transistor TFT2, the second transistor TFT2 is turned on. The high or low level of the signal for controlling the on or off of the second transistor TFT2 depends on the type of the second transistor. Optionally, the second transistor TFT2 may be a P-type transistor or an N-type transistor.

Any one or more of the split-screen display control signal terminal V1, the half-screen control signal terminal V2, and the display area adjustment signal terminal V3 in the embodiments of the present disclosure may be only a line for transmitting corresponding signals, and may not contain signal sources that generate the corresponding signals. It may also include a line for transmitting the corresponding signals and signal sources for generating the corresponding signals.

Optionally, when the display device in the embodiments of the present disclosure is a foldable display device, a signal output state of the split-screen display control signal terminal V1 is triggered by folding and flattening operations of the display device. Specifically, when a relative positional relationship between the first display area 1 and the second display area 2 is such that the display device is folded, the split-screen display control signal terminal V1 outputs a second signal to a control electrode of the first transistor TFT1 to turn off TFT1. When a relative positional relationship between the first display area 1 and the second display area 2 is such that the display device is flattened, the split-screen display control signal terminal V1 outputs a first control signal to the control electrode of the first transistor TFT1 to turn on TFT1.

Optionally, when the display device in the embodiments of the present disclosure is a foldable display device, a signal output state of the half-screen control signal terminal V2 is triggered by folding and flattening operations of the display device. Specifically, when a relative positional relationship between the first display area 1 and the second display area 2 is such that the display device is flattened, the half-screen control signal terminal V2 outputs a second signal to the control electrode of the second transistor TFT2 to turn off the TFT2. When a relative positional relationship between the first display area 1 and the second display area 2 is such that the display device is folded, the half-screen control signal terminal V2 outputs a first control signal to the control electrode of the second transistor TFT2 to turn on the TFT2.

In an optional embodiment of the present disclosure, when the display device in the embodiments of the present disclosure is a foldable display device, a signal output state of the display area adjustment signal terminal V3 may also be triggered by folding and flattening operations of the display device.

In the embodiments of the present disclosure, in the second gate driving sub-circuit, the second signal output terminal of each shift register is used to electrically couple to the corresponding row of sub-pixels;

And/or, in the first gate driving sub-circuit, the second signal output terminals of the shift registers other than the shift register EM-(n) are used to electrically couple to the corresponding rows of sub-pixels.

In the gate driving circuit in the embodiments of the present disclosure, each shift register in the second gate driving sub-circuit corresponding to the second display area 2 has the same structure and connection relationship. Optionally, in the first gate driving sub-circuit corresponding to the first display area 1, all shift registers except for the shift register EM-(n) have the same structure and connection relationship; and all shift registers except for the shift register EM-(n) have the same structure and connection relationship as the shift registers in the second gate driving sub-circuit corresponding to the second display area 2. Optionally, the shift registers in the first gate driving sub-circuit corresponding to the first display area 1 and the shift registers in the second gate driving sub-circuit corresponding to the second display area 2 all have the same structure and connection relationship.

Figure 11:
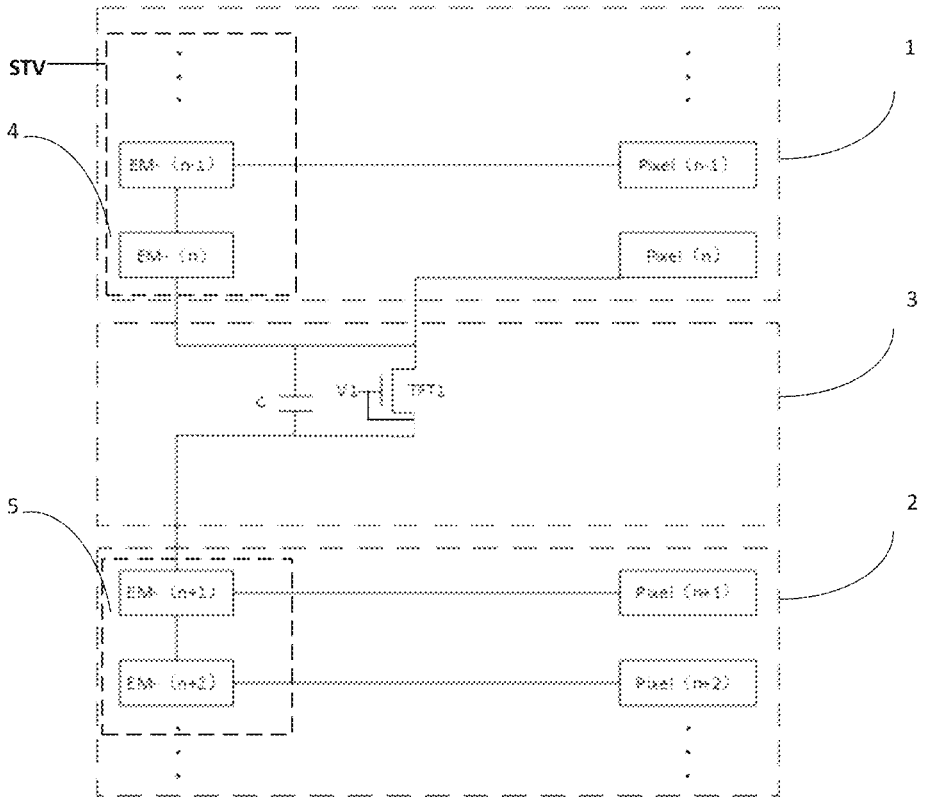
FIG. 11 is a schematic diagram of a part of the structure of a gate driving circuit in an embodiment of the present disclosure, and a corresponding relationship between the gate driving circuit and a display area, and a corresponding relationship between the gate driving circuit and a row of sub-pixels.

In an optional embodiment of the present disclosure, as shown in FIG. 11, in the gate driving circuit, the first gate driving sub-circuit includes M cascaded first shift registers EM(1)~EM(M) electrically coupled in sequence, the second gate driving sub-circuit includes N cascaded second shift registers EM(n+1)~EM(n+N) electrically coupled in sequence, where M and N are positive integers greater than or equal to 2, respectively.

An input terminal of the first gate driving sub-circuit is electrically coupled to the gate start signal terminal STV, and a plurality of output terminals of the first gate driving sub-circuit are electrically coupled to multiple rows of sub-pixels in the first display area of the display device, for outputting a scan signal and controlling the first display area to display according to the scan signal.

An input terminal of the display area control unit is coupled to one of the output terminals of the first gate driving sub-circuit, and is used to receive the scan signal output by the first gate driving sub-circuit. A control terminal of the display area control unit is coupled to the split-screen control signal terminal, and is used to receive a split-screen control signal output by the split-screen control signal terminal, and an output terminal of the display area control unit is used to output or not output the scan signal according to the split-screen control signal terminal. An input terminal of the second gate driving sub-circuit is electrically coupled to the output terminal of the display area control unit, and a plurality of output terminals of the second gate driving sub-circuit are coupled to multiple rows of sub-pixels in the second display area of the display device, for controlling a display state of the second display area according to whether the scan signal is received or not.

When both the first display area 1 and the second display area 2 display, that is, in a full-screen display phase, the rows of sub-pixels of the first display area corresponding to the first gate driving sub-circuit receive the scan signal output by the first gate driving sub-circuit and perform corresponding display. The split-screen control signal terminal receives a first control signal, so that the output terminal of the display area control unit outputs a scan signal according to the split-screen control signal. The rows of sub-pixels of the second display area corresponding to the second gate driving sub-circuit perform corresponding display according to the received scan signal.

When the first display area 1 displays and the second display area 2 does not display, that is, in a split-screen display phase, the rows of sub-pixels of the first display area corresponding to the first gate driving sub-circuit receive a scan signal output by the first gate driving sub-circuit, and perform corresponding display. The split-screen control signal terminal receives a second control signal, so that the output terminal of the display area control unit does not output the scan signal according to the split-screen control signal. Since the rows of sub-pixels in the second display area corresponding to the second gate driving sub-circuits do not receive the scan signal, they do not perform display.

In an optional embodiment of the present disclosure, as shown in FIG. 11, the display area control unit includes: a first transistor TFT1.

A first electrode of the first transistor TFT1 is used as an input terminal of the display area control unit 3 and is electrically coupled to an output terminal of the first gate driving sub-circuit, a control electrode of the first transistor TFT1 is electrically coupled to the split-screen control signal terminal, and a second electrode of the first transistor TFT1 is used as an output terminal of the display area control unit.

The display area control unit is configured to receive a first control signal output by the split-screen control signal terminal in the full-screen display phase, and to output a scan signal output by an output terminal of the first gate driving sub-circuit at the output terminal of the display area control unit, and receives a second control signal output by the split-screen control signal terminal without outputting the scan signal at the output terminal in the split-screen display phase.

In the embodiments of the present disclosure, the signal output terminal of the shift register EM-(n) is electrically coupled to the first electrode of the first transistor TFT1, and the signal input terminal of the shift register EM-(n+1) is electrically coupled to the second electrode of the first transistor TFT1.

When the first transistor TFT1 is turned on, a path for outputting the scan signal output by the signal output terminal of the shift register EM-(n) to the second gate driving sub-circuit is conducted. The second gate driving sub-circuit drives the rows of sub-pixels of the second display area corresponding to the second gate driving sub-circuit to perform corresponding display according to the received scan signal.

When the first transistor TFT1 is turned off, a path for outputting the scan signal output by the signal output terminal of the shift register EM-(n) to the second gate driving sub-circuit is decoupled. The second gate driving sub-circuit does not receive the scan signal, and the row of sub-pixels of the second display area corresponding to the second gate driving sub-circuit is no longer driven according to the scan signal for corresponding display.

The on and off states of the first transistor TFT1 are controlled by the split-screen control signal terminal V1 electrically coupled to the control electrode of the first transistor TFT1. Optionally, when the split-screen control signal terminal V1 outputs a second signal being at a high level to the control electrode of the first transistor TFT1, the first transistor TFT1 is turned off; when the split-screen control signal terminal V1 outputs a first control signal being at a low level to the control electrode of the first transistor TFT1, the first transistor TFT1 is turned on. The high or low level of the signal for controlling the on or off of the first transistor TFT1 depends on the type of the first transistor.

The split-screen control signal terminal V1 in the embodiments of the present disclosure may only be a line for transmitting the corresponding signal, and does not include a signal source that generates the corresponding signal. It may also include a line for transmitting the corresponding signal and a signal source for generating the corresponding signal.

In the embodiments of the present disclosure, the display area control unit 3 further includes a capacitor C, and two terminals of the capacitor C are electrically coupled to the input terminal of the display area control unit 3 and the output terminal of the display area control unit 3, respectively. The capacitor C is used to adjust a continuity of the signal passing through the first transistor TFT1.

Those skilled in the art may understand that a number, an arrangement, and a connection relationship of terminals of the first shift register, the second shift register, and the display area control unit 3 for output signals and input signals may be designed according to actual requirements. The number, the arrangement, and the connection relationship of the terminals for outputting signals and inputting signals in the foregoing embodiments are merely examples of the gate driving circuit provided in the embodiments of the present disclosure. The number, the arrangement, and the connection relationship of the shift registers in the gate driving circuit and the terminals of the display area control unit 3 provided in the embodiment of the disclosure may be adjusted adaptively, and a technical solution obtained after the adaptive adjustment still belongs to the protection scope of the embodiments of the disclosure.

The embodiments of the present disclosure also provide a display device. As shown in FIGS. 5 to 7 and 11, the display device includes a first display area 1, a second display area 2, and the gate driving circuit in the foregoing embodiments.

The first gate driving sub-circuit in the gate driving circuit is electrically coupled to each row of sub-pixels in the first display area 1.

The display area control unit 3 in the gate driving circuit is electrically coupled between the first gate driving sub-circuit and the second gate driving sub-circuit.

The second gate driving sub-circuit in the gate driving circuit is electrically coupled to each row of sub-pixels in the second display area 2.

The display device provided by the embodiments of the present disclosure has the same inventive concept and the same beneficial effects as the previous embodiments. For the content not shown in the display device in detail, please refer to the previous embodiments, which will not be repeated here.

In the embodiments of the present disclosure, the display device may further include a driving control circuit for providing a gate start signal and a split-screen control signal.

Figure 13:
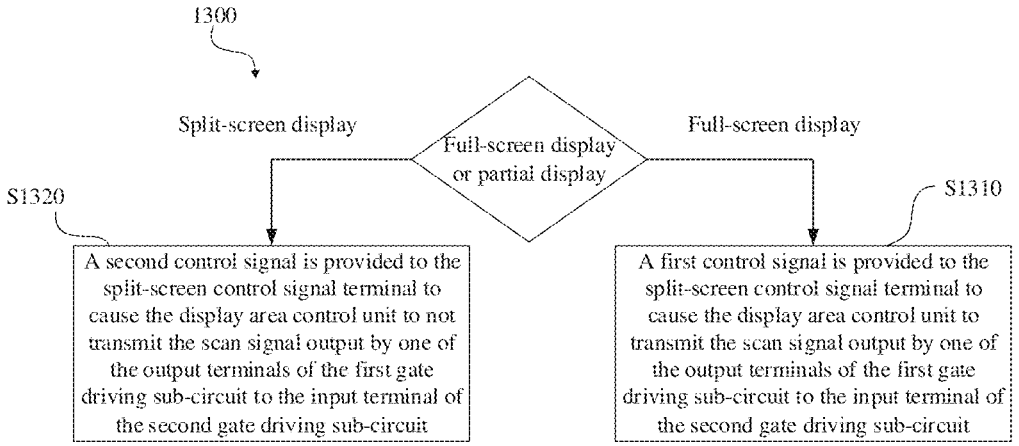
FIG. 13 shows a flowchart of a display control method according to an embodiment of the present disclosure.

The embodiments of the present disclosure also provide a display control method. As shown in FIG. 13, the display control method 1300 may be applied to the gate driving circuit in the foregoing embodiments. The method includes: first determining a display state of the display device, that is, whether the display device is in a full-screen display phase or in a split-screen display phase.

If in a full-screen display phase, as shown in step S1310, for example, the driving control circuit provides a gate start signal to the gate start signal terminal, so that the first gate driving sub-circuit controls the first display area 1 to display according to the gate start signal; and provides a first control signal to the split-screen control signal terminal to cause the display area control unit 3 to transmit a scan signal output by one of the output terminals of the first gate driving sub-circuit to the input terminal of the second gate driving sub-circuit, and the second gate driving sub-circuit controls the second display area 2 to display according to the scan signal.

If in a partial display phase, as shown in step S1320, for example, the driving control circuit provides a gate start signal to the gate start signal terminal, so that the first gate driving sub-circuit controls the first display area 1 to display according to the gate start signal, and provides a first control signal to the split-screen control signal terminal, and provides a second control signal to the split-screen control signal terminal, the display area control unit 3 decouples the first gate driving sub-circuit and the second gate driving sub-circuit and does not transmit the scan signal output by one of the output terminals of the first gate driving sub-circuit to the input terminal of the second gate driving sub-circuit, so that the second display area 2 stops displaying.

In the full-screen display phase, at least the first display area 1 of the display device and the second display area 2 of the display device are in an image display state for image output. In this phase, the gate start signal terminal STV outputs the gate start signal to the first gate driving sub-circuit, and the first gate driving sub-circuit outputs a scan signal to each row of sub-pixels corresponding to the first gate driving sub-circuit according to the received gate start signal, and each row of sub-pixels corresponding to the first gate driving sub-circuit performs image display according to the scan signal. In addition, in a case that a portion of the display area control unit 3 for controlling the on-off of the signal transmission between the first gate driving sub-circuit and the second gate driving sub-circuit is in an on state, the first gate driving sub-circuit output the scan signal to the display area control unit 3, and the display area control unit 3 outputs the scan signal to the second gate driving sub-circuit. According to the received scan signal, the second gate driving sub-circuit outputs a scan signal to each row of sub-pixels corresponding to the second gate driving sub-circuit according to the scan signal, and each row of sub-pixels corresponding to the second gate driving sub-circuit performs image display based on the scan signal. Therefore, the first display area 1 and the second display area 2 in the embodiments of the present disclosure are both displayed according to the gate start signal output by the same gate start signal terminal STV, which greatly reduces differences in display conditions between two display areas caused by differences of the signals.

In an optional embodiment of the present disclosure, outputting, by the display area control unit 3 in the gate driving circuit, the gate start signal of the first gate driving sub-circuit to the second gate driving sub-circuit in the gate driving circuit, includes:

the first transistor TFT1 in the display area control unit 3 is turned on according to a first control signal from the split-screen display control signal terminal V1 received by the control electrode of the first transistor TFT1;

the second transistor TFT2 in the display area control unit 3 is turned off according to a second signal from the half-screen control signal terminal V2 received by the control electrode of the second transistor TFT2; and the gate start signal is sequentially output to the signal input terminal of the second gate driving sub-circuit through the first gate driving sub-circuit and the first transistor TFT1.

In the embodiments of the present disclosure, when the first transistor TFT1 is turned on, a path for outputting the gate start signal output by the gate signal module EM-(n) to the second gate driving sub-circuit and to the row of sub-pixels corresponding to the gate signal module EM-(n) is conducted. The second gate driving sub-circuit and the row of sub-pixels corresponding to the gate signal module EM-(n) display according to the gate start signal output by the gate signal module EM-(n). An off state of the second transistor TFT2 decouples the display area adjustment signal terminal V3 and the second gate driving sub-circuit, and a signal from the display area adjustment signal terminal V3 may not be output to the second gate driving sub-circuit.

Figure 10:
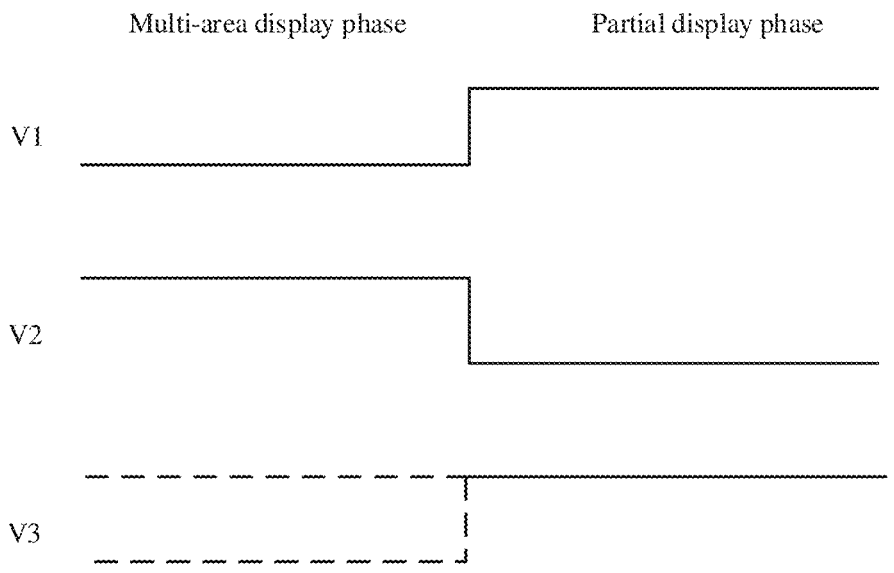
FIG. 10 a schematic diagram of signal output conditions of a split-screen display control signal terminal V1, a half-screen control signal terminal V2, and a display area adjustment signal terminal V3 of a gate driving circuit in an embodiment of the present disclosure in a multi-area display phase and in a partial display phase.

Optionally, the respective signal output conditions of the split-screen control signal terminal V1, the half-screen control signal terminal V2, and the display area adjustment signal terminal V3 are shown in FIG. 10. The split-screen display control signal terminal V1 outputs a first control signal being at low level, and the half-screen control signal terminal V2 outputs a second signal being at high level. A signal output by the display area adjustment signal terminal V3 is not limited, and may be a low-level signal or a high-level signal, as shown in a dotted line in FIG. 10; or no signal is output.

Optionally, in a partial display phase, the first display area 1 displays and the second display area 2 does not display. A portion of the display area control unit 3 for controlling the on-off of the signal transmission between the first gate driving sub-circuit and the second gate driving sub-circuit is decoupled, the gate start signal terminal STV outputs the gate start signal to the first gate driving sub-circuit, and the first gate driving sub-circuit outputs the received gate start signal to each row of sub-pixels corresponding to the first gate driving sub-circuit, so that the each row of sub-pixels corresponding to the first gate driving sub-circuit displays image according to the gate start signal output by the gate start signal terminal STV. The display area control unit 3 decoupled a circuit that causes the second gate driving sub-circuit to receive the gate start signal from the first gate driving sub-circuit, and the second gate driving sub-circuit stops receiving the gate start signal from the first gate driving sub-circuit. Therefore, the second gate driving sub-circuit no longer controls the display state of each row of sub-pixels corresponding to the second gate driving sub-circuit according to the gate start signal.

In an optional embodiment of the present disclosure, decoupling, by the display area control unit, the first gate driving sub-circuit and the second gate driving sub-circuit includes:

the first transistor TFT1 in the display area control unit is turned off according to a second signal from the split-screen display control signal terminal V1 received by the control electrode of the first transistor TFT1.

In the embodiments of the present disclosure, the first transistor TFT1 is turned-on or off under control of the split-screen display control signal terminal V1. The on and off operations of the first transistor TFT1 are at least used to control the on and off of the gate start signal between the first gate driving sub-circuit and the second gate driving sub-circuit. Optionally, the second signal is a signal being at a high level.

In an optional embodiment of the present disclosure, after the display area control unit 3 decouples the first gate driving sub-circuit and the second gate driving sub-circuit to cause the second display area 2 to stop displaying, the process further includes:

the display area control unit 3 outputs an off display signal to the second gate driving sub-circuit, and the second gate driving sub-circuit controls the second display area 2 to stop displaying according to the off display signal.

In a partial display phase, a shift register EM-(n) outputs a signal EOUT1 to the corresponding row of sub-pixels, outputs a signal EOUT1−1 to a first shift register EM-(n+1) in the second gate driving sub-circuit; and the first shift register EM-(n+1) in the second gate driving sub-circuit outputs a signal EOUT2 to the corresponding row of sub-pixels, waveforms of these signals are shown in FIG. 9. It may be seen that in the partial display phase, the second display area 2 does not display, the second display area 2 does not receive the gate start signal output by the shift register EM-(n), and the corresponding EOUT1−1 has no effective waveform display. The signal EOUT2 output from the first shift register EM-(n+1) of the second gate driving sub-circuit to the corresponding row of sub-pixels is an off display signal output by the display area adjustment signal terminal V3, and the off display signal is a signal being at a high level at this time.

In an optional embodiment of the present disclosure, the display control method further includes: in the partial display phase, the display area control unit 3 decouples the first gate driving sub-circuit and the second gate driving sub-circuit, and outputs a gate start signal from the display area adjustment signal terminal V3, while the first gate driving sub-circuit receives the off display signal through the gate start signal terminal STV, so that the second gate driving sub-circuit controls the second display area 2 to display according to the gate start signal from the display area adjustment signal terminal V3, and the first gate driving sub-circuit controls the first display area 1 to stop displaying according to the off display signal.

In the embodiments of the present disclosure, when the first display area 1 no longer displays and the second display area 2 displays, the first transistor TFT1 is turned off, the second transistor TFT2 is turned on, and the gate start signal output by the display area adjustment signal terminal V3 is output to the second gate driving sub-circuit, so that the second gate driving sub-circuit performs display. Alternatively, the gate start signal output by the display area adjustment signal terminal V3 is output to the second gate driving sub-circuit and the row of sub-pixels corresponding to the shift register EM-(n), the second gate driving sub-circuit and the row of sub-pixels corresponding to the shift register EM-(n) display. The first display area 1 stops displaying.

In an optional embodiment of the present disclosure, outputting, by the display area control unit 3, a gate start signal to the second gate driving sub-circuit includes:

the second transistor TFT2 in the display area control unit 3 is turned on according to a first control signal from the half-screen control signal terminal V2 received by the control electrode of the second transistor TFT2; and the gate start signal from the display area adjustment signal terminal V3 sequentially passes through the first electrode of the second transistor and the second electrode of the second transistor TFT2, and is output to the signal input terminal of the second gate driving sub-circuit.

In an optional embodiment of the present disclosure, the display area control unit 3 in the gate driving circuit outputs a scan signal of the first gate driving sub-circuit to the second gate driving sub-circuit in the gate driving circuit, includes that:

the first transistor TFT1 in the display area control unit 3 is turned on according to a first control signal from the split-screen control signal terminal V1 received by the control electrode of the first transistor TFT1; and the scan signal is sequentially output to the input terminal of the second gate driving sub-circuit through the first gate driving sub-circuit and the first transistor TFT1.

In the embodiments of the present disclosure, when the first transistor TFT1 is turned on, a path for outputting the scan signal output by the shift register EM-(n) to the second gate driving sub-circuit is conducted. The second gate driving sub-circuit controls the row of sub-pixels corresponding to the second gate driving sub-circuit to display according to the scan signal output by the shift register EM-(n).

Figure 12:
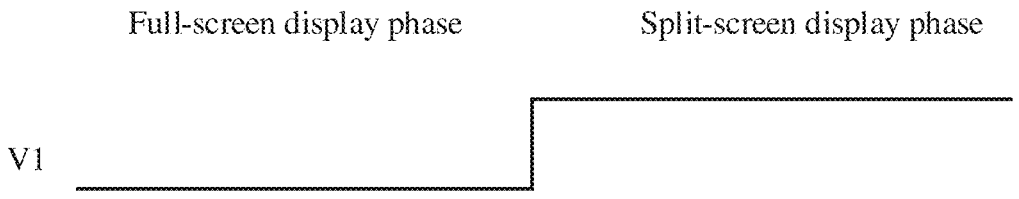
FIG. 12 is a schematic diagram of signal output conditions of a split-screen display control signal terminal V1 of a gate driving circuit in an embodiment of the present disclosure in a multi-area display phase and in a partial display phase.

Optionally, signal output conductions of the split-screen display control signal terminal V1 are shown in FIG. 12. The split-screen display control signal terminal V1 outputs a first control signal being at a low level.

Optionally, in a partial display phase, the first display area 1 displays and the second display area 2 does not display. A portion of the display area control unit 3 for controlling the on-off of the signal transmission between the first gate driving sub-circuit and the second gate driving sub-circuit is decoupled, the gate start signal terminal STV outputs the gate start signal to the first gate driving sub-circuit, and the first gate driving sub-circuit outputs the received gate start signal to each row of sub-pixels corresponding to the first gate driving sub-circuit, so that the each row of sub-pixels corresponding to the first gate driving sub-circuit displays image according to the gate start signal output by the gate start signal terminal STV. The display area control unit 3 decoupled a circuit that causes the second gate driving sub-circuit to receive the gate start signal from the first gate driving sub-circuit, and the second gate driving sub-circuit stops receiving the gate start signal from the first gate driving sub-circuit. Therefore, the second gate driving sub-circuit no longer controls the display state of each row of sub-pixels corresponding to the second gate driving sub-circuit according to the gate start signal.

In an optional embodiment of the present disclosure, decoupling, by the display area control unit, the first gate driving sub-circuit and the second gate driving sub-circuit includes:

the first transistor TFT1 in the display area control unit is turned off according to a second control signal from the split-screen display control signal terminal V1 received by the control electrode of the first transistor TFT1.

In the embodiments of the present disclosure, the first transistor TFT1 is turned-on or off under control of the split-screen display control signal terminal V1. The on and off operations of the first transistor TFT1 are at least used to control the on and off of the gate start signal between the first gate driving sub-circuit and the second gate driving sub-circuit. Optionally, the second control signal is a signal being at a high-level.

In an optional embodiment of the present disclosure, the display device further includes a third display area. Therefore, the display control method of each embodiment of the present disclosure may also be applied between the third display area and other display areas that have a display cooperation relationship with the third display area. Therefore, the relevant technical solutions in the multi-area display phase in the display control method of the embodiments of the present disclosure are not limited to the case that the display device has the first display area 1 and the second display area 2, but may also be applied to a situation that the display device has more display areas.

By applying a pixel driving circuit and a method for driving the pixel provided by the embodiments of the present disclosure, at least the following beneficial effects may be achieved as follows.

1) The gate driving circuit, the display device, and the display control method provided by the embodiments of this disclosure are used to create a connection relationship of the gate start signal between at least two adjacent display areas, and to cause the gate start signal in the first display area to be output to the second display area under certain conditions, so that the first display area and the second display area may display under control of the same gate start signal, which at least to reduce display differences between adjacent display areas due to differences in the received gate start signal.

2) The gate driving circuit, the display device, and the display control method provided by the embodiments of the present disclosure may make any two adjacent rows of sub-pixels of the display device be controlled by the gate start signal from same source, and when two adjacent display areas display at the same time, there may be no "split screen" phenomenon between two adjacent display areas due to differences of waveforms of the gate start signals.

3) In the gate driving circuit, the display device, and the display control method provided by the embodiments of the present disclosure, in an display area that does not need to display, an off display signal is output to the display area that does not need to display through the gate start signal terminal or the display area control unit, so that the display area that does not need to display stops displaying, which avoid affecting display effects of other display areas that need to display.

Those skilled in the art may understand that the various operations, methods, steps, measures, and solutions in the process that have been discussed in this disclosure may be alternated, changed, combined, or deleted. Further, various operations, methods, and other steps, measures, and solutions in the process that have been discussed in this disclosure may also be alternated, changed, rearranged, decomposed, combined, or deleted. Further, the steps, measures, and solutions in the various operations, methods, and procedures disclosed in the present disclosure in the related art may also be alternated, changed, rearranged, decomposed, combined or deleted.

The terms "first" and "second" are only used for descriptive purposes, and cannot be understood as indicating or implying relative importance or implicitly indicating the number of indicated technical features. Thus, the features defined with "first" and "second" may explicitly or implicitly include one or more of these features. In the description of the present disclosure, unless otherwise specified, "plurality" means two or more.

It should be understood that although the various steps in the flowchart of the drawings are displayed in sequence as indicated by the arrows, these steps are not necessarily performed in sequence in the order indicated by the arrows. Unless explicitly stated in this article, the execution of these steps is not strictly limited in order, and they may be executed in other orders. Moreover, at least part of the steps in the flowchart of the drawings may include multiple sub-steps or multiple phases. These sub-steps or phases are not necessarily executed at the same time, but may be executed at different times, and the order of execution is also not necessarily performed sequentially, but may be performed in turn or alternately with other steps or at least a part of sub-steps or phases of other steps.

The above are only part of the implementation of this disclosure. It should be pointed out that for those of ordinary skill in the art, without departing from the principles of this disclosure, several improvements and modifications may be made, and these improvements and modifications should also be considered in the protection scope of this disclosure.

What is claimed is:

1. A gate driving circuit, comprising:

a first gate driving sub-circuit, wherein an input terminal of the first gate driving sub-circuit is electrically coupled to a gate start signal terminal, a plurality of output terminals of the first gate driving sub-circuit are electrically coupled to multiple rows of sub-pixels in a first display area of a display device, and the first gate driving sub-circuit is configured to output a scan signal and control the first display area to display according to the scan signal;

a display area control unit, wherein an input terminal of the display area control unit is coupled to one of the plurality of output terminals of the first gate driving sub-circuit, and is configured to receive the scan signal output by the first gate driving sub-circuit, a control terminal of the display area control unit is coupled to a split-screen control signal terminal, and is configured to receive a split-screen control signal output by the split-screen control signal terminal, and an output terminal of the display area control unit is configured to output or not output the scan signal according to the split-screen control signal; and a second gate driving sub-circuit, wherein an input terminal of the second gate driving sub-circuit is electrically coupled to the output terminal of the display area control unit, and a plurality of output terminals of the second gate driving sub-circuit are electrically coupled to multiple rows of sub-pixels in a second display area of the display device, and the second gate driving sub-circuit is configured to control a display state of the second display area according to whether the scan signal is received or not, wherein the display area control unit comprises a first transistor and a second transistor;

wherein a first electrode of the first transistor is used as the input terminal of the display area control unit and is electrically coupled to one of the output terminals of the first gate driving sub-circuit, a control electrode of the first transistor is electrically coupled to the split-screen control signal terminal, and a second electrode of the first transistor is used as the output terminal of the display area control unit; and wherein a first electrode of the second transistor is electrically coupled to the display area adjustment signal terminal, a control electrode of the second transistor is electrically coupled to the half-screen control signal terminal, and a second electrode of the second transistor is coupled to the second electrode of the first transistor and the input terminal of the second gate driving sub-circuit.

2. The gate driving circuit according to claim 1, wherein the display area control unit is configured to: in a full-screen display phase, receive a first control signal output by the split-screen control signal terminal and output the scan signal output by one of the output terminals of the first gate driving sub-circuit at the output terminal of the display area control unit; and in a split-screen display phase, receive a second control signal output by the split-screen control signal terminal without outputting the scan signal at the output terminal of the display area control unit.

3. The gate driving circuit according to claim 1, wherein the display area control unit further comprises: a capacitor, wherein two terminals of the capacitor are electrically coupled to the input terminal of the display area control unit and the output terminal of the display area control unit, respectively.

4. The gate driving circuit according to claim 1, wherein the first gate driving sub-circuit comprises M cascaded first shift registers, and the second gate driving sub-circuit comprises N cascaded second shift registers, wherein M and N are positive integers greater than or equal to 2, respectively; and wherein a signal input terminal of a first stage of the first shift register is coupled to the gate start signal terminal, an output terminal of a M stage of the first shift register is coupled to the input terminal of the display area control unit, and a signal input terminal of a first stage of the second shift register is coupled to the output terminal of the display area control unit.

5. A display device, comprising the first display area, the second display area, and the gate driving circuit according to claim 1, wherein:

the first gate driving sub-circuit in the gate driving circuit is electrically coupled to each row of sub-pixels in the first display area;

the display area control unit in the gate driving circuit is electrically coupled between the first gate driving sub-circuit and the second gate driving sub-circuit; and the second gate driving sub-circuit in the gate driving circuit is electrically coupled to each row of sub-pixels in the second display area.

6. The display device according to claim 5, further comprising: a driving control circuit configured to provide the gate start signal and the split-screen control signal.

7. A display control method applied to the gate driving circuit according to claim 1, comprising:

in a full-screen display phase, providing a first control signal to the split-screen control signal terminal to cause the display area control unit to transmit the scan signal output by one of the output terminals of the first gate driving sub-circuit to the input terminal of the second gate driving sub-circuit; and in a split-screen display phase, providing a second control signal to the split-screen control signal terminal to cause the display area control unit to not transmit the scan signal output by one of the output terminals of the first gate driving sub-circuit to the input terminal of the second gate driving sub-circuit.

8. The gate driving circuit according to claim 2, wherein the display area control unit further comprises: a capacitor, wherein two terminals of the capacitor are electrically coupled to the input terminal of the display area control unit and the output terminal of the display area control unit, respectively.

9. The gate driving circuit according to claim 2, wherein the first gate driving sub-circuit comprises M cascaded first shift registers, and the second gate driving sub-circuit comprises N cascaded second shift registers, wherein M and N are positive integers greater than or equal to 2, respectively; and wherein a signal input terminal of a first stage of the first shift register is coupled to the gate start signal terminal, an output terminal of a M stage of the first shift register is coupled to the input terminal of the display area control unit, and a signal input terminal of a first stage of the second shift register is coupled to the output terminal of the display area control unit.

10. The gate driving circuit according to claim 3, wherein the first gate driving sub-circuit comprises M cascaded first shift registers, and the second gate driving sub-circuit comprises N cascaded second shift registers, wherein M and N are positive integers greater than or equal to 2, respectively; and wherein a signal input terminal of a first stage of the first shift register is coupled to the gate start signal terminal, an output terminal of a M stage of the first shift register is coupled to the input terminal of the display area control unit, and a signal input terminal of a first stage of the second shift register is coupled to the output terminal of the display area control unit.

11. The gate driving circuit according to claim 8, wherein the first gate driving sub-circuit comprises M cascaded first shift registers, and the second gate driving sub-circuit comprises N cascaded second shift registers, wherein M and N are positive integers greater than or equal to 2, respectively; and wherein a signal input terminal of a first stage of the first shift register is coupled to the gate start signal terminal, an output terminal of a M stage of the first shift register is coupled to the input terminal of the display area control unit, and a signal input terminal of a first stage of the second shift register is coupled to the output terminal of the display area control unit.

12. The display device according to claim 5, wherein the display area control unit is configured to: in a full-screen display phase, receive a first control signal output by the split-screen control signal terminal and output the scan signal output by one of the output terminals of the first gate driving sub-circuit at the output terminal of the display area control unit; and in a split-screen display phase, receive a second control signal output by the split-screen control signal terminal without outputting the scan signal at the output terminal of the display area control unit.

13. The display device according to claim 5, wherein the display area control unit further comprises: a capacitor, and two terminals of the capacitor are electrically coupled to the input terminal of the display area control unit and the output terminal of the display area control unit, respectively.

14. The display device according to claim 12, wherein the display area control unit further comprises: a capacitor, and two terminals of the capacitor are electrically coupled to the input terminal of the display area control unit and the output terminal of the display area control unit, respectively.

15. The display device according to claim 5, wherein the first gate driving sub-circuit comprises M cascaded first shift registers, and the second gate driving sub-circuit comprises N cascaded second shift registers, wherein M and N are positive integers greater than or equal to 2, respectively; and wherein a signal input terminal of a first stage of the first shift register is coupled to the gate start signal terminal, an output terminal of a M stage of the first shift register is coupled to the input terminal of the display area control unit, and a signal input terminal of a first stage of the second shift register is coupled to the output terminal of the display area control unit.

16. A display control method applied to the gate driving circuit according to claim 2, comprising:

in a full-screen display phase, providing a first control signal to the split-screen control signal terminal to cause the display area control unit to transmit the scan signal output by one of the output terminals of the first gate driving sub-circuit to the input terminal of the second gate driving sub-circuit; and in a split-screen display phase, providing a second control signal to the split-screen control signal terminal to cause the display area control unit to not transmit the scan signal output by one of the output terminals of the first gate driving sub-circuit to the input terminal of the second gate driving sub-circuit.

17. A display control method applied to the gate driving circuit according to claim 3, comprising:

in a full-screen display phase, providing a first control signal to the split-screen control signal terminal to cause the display area control unit to transmit the scan signal output by one of the output terminals of the first gate driving sub-circuit to the input terminal of the second gate driving sub-circuit; and in a split-screen display phase, providing a second control signal to the split-screen control signal terminal to cause the display area control unit to not transmit the scan signal output by one of the output terminals of the first gate driving sub-circuit to the input terminal of the second gate driving sub-circuit.

18. A display control method applied to the gate driving circuit according to claim 4, comprising:

in a full-screen display phase, providing a first control signal to the split-screen control signal terminal to cause the display area control unit to transmit the scan signal output by one of the output terminals of the first gate driving sub-circuit to the input terminal of the second gate driving sub-circuit; and in a split-screen display phase, providing a second control signal to the split-screen control signal terminal to cause the display area control unit to not transmit the scan signal output by one of the output terminals of the first gate driving sub-circuit to the input terminal of the second gate driving sub-circuit.

* * * * *